US011325771B2

(12) United States Patent
Freedman et al.

(10) Patent No.: US 11,325,771 B2
(45) Date of Patent: May 10, 2022

(54) MOISTURE TIGHT CONTAINERS AND METHODS OF MAKING AND USING THE SAME

(71) Applicant: CSP Technologies, Inc., Auburn, AL (US)

(72) Inventors: Jonathan R. Freedman, Auburn, AL (US); Donald Lee Huber, Auburn, AL (US); Brian Tifft, Auburn, AL (US); Franklin Lee Lucas, Jr., Opelika, AL (US)

(73) Assignee: CSP Technologies, Inc., Auburn, AL (US)

( * ) Notice: Subject to any disclaimer, the term of this patent is extended or adjusted under 35 U.S.C. 154(b) by 0 days.

(21) Appl. No.: 16/637,623

(22) PCT Filed: Aug. 8, 2018

(86) PCT No.: PCT/US2018/045697
§ 371 (c)(1),
(2) Date: Feb. 7, 2020

(87) PCT Pub. No.: WO2019/032636
PCT Pub. Date: Feb. 14, 2019

(65) Prior Publication Data

US 2020/0255206 A1 Aug. 13, 2020

Related U.S. Application Data

(60) Provisional application No. 62/542,358, filed on Aug. 8, 2017, provisional application No. 62/542,391, filed on Aug. 8, 2017.

(51) Int. Cl.

| | |
|---|---|
| ***B65D 81/26*** | (2006.01) |
| ***B65D 43/16*** | (2006.01) |
| ***B65D 53/02*** | (2006.01) |

(52) U.S. Cl.
CPC ..... *B65D 81/266* (2013.01); *B65D 43/162* (2013.01); *B65D 53/02* (2013.01)

(58) Field of Classification Search
CPC .... B65D 43/162; B65D 81/266; B65D 81/22; B65D 81/38
(Continued)

(56) References Cited

U.S. PATENT DOCUMENTS 4,116,352 A * 9/1978 Davis ..... B65D 51/145 215/270
4,783,056 A 11/1988 Abrams
(Continued)

FOREIGN PATENT DOCUMENTS

CN 102574622 A 7/2012
CN 103917460 A 7/2014
(Continued)

OTHER PUBLICATIONS

International Search Report for International Application No. PCT/US2018/045697, dated Nov. 20, 2018.
(Continued)

*Primary Examiner* — Rafael A Ortiz
*Assistant Examiner* — Sanjidul Islam
(74) *Attorney, Agent, or Firm* — Mark T. Vogelbacker; Bokert Seamans Cherin & Mellott, LLC

(57) ABSTRACT

A method for storing and preserving moisture sensitive products includes providing a moisture tight container (400) having an insert (300) made from a desiccant entrained polymer that is less than 3.25 g in mass, disposing a plurality of moisture sensitive products into the interior compartment when the container is in the open position, and moving the container into the closed position, thereby creating a moisture tight seal between the lid (420) and the container body (401). The container provides a shelf life to the moisture
(Continued)

sensitive products of at least 12 months. The container, when in the closed position, has a moisture vapor transmission rate, at ambient conditions of 30° C. and 75% relative humidity (RH), of less than 500lig/day.

23 Claims, 32 Drawing Sheets

(58) Field of Classification Search
USPC ..... 206/204
See application file for complete search history.

(56) References Cited

U.S. PATENT DOCUMENTS

| | | | |
|---|---|---|---|
| 5,270,011 | A | 12/1993 | Altherr |
| 5,911,937 | A | 6/1999 | Hekal |
| 6,080,350 | A | 6/2000 | Hekal |
| 6,124,006 | A | 9/2000 | Hekal |
| 6,130,263 | A | 10/2000 | Hekal |
| 6,174,952 | B1 | 1/2001 | Hekal et al. |
| 6,194,079 | B1 | 2/2001 | Hekal |
| 6,214,255 | B1 | 4/2001 | Hekal |
| 6,221,446 | B1 | 4/2001 | Hekal |
| RE37,676 | E | 4/2002 | Abrams et al. |
| 6,486,231 | B1 | 11/2002 | Hekal |
| 7,005,459 | B2 | 2/2006 | Hekal |
| 8,622,231 | B2 | 1/2014 | Wooldridge |
| 8,789,692 | B2 | 7/2014 | Chang et al. |
| 9,533,803 | B1 | 1/2017 | Giraud et al. |
| 9,650,181 | B2 | 5/2017 | Giraud |
| 9,745,101 | B2 | 8/2017 | Freedman et al. |
| 10,669,079 | B2 * | 6/2020 | Freedman ..... G01N 33/48778 |
| 2011/0000930 | A1 * | 1/2011 | Logel ..... B65D 43/169 220/849 |
| 2011/0056951 | A1 | 3/2011 | Wooldridge |
| 2011/0127269 | A1 | 6/2011 | Bucholtz et al. |
| 2013/0220844 | A1 * | 8/2013 | Logel ..... B65D 81/266 206/204 |
| 2016/0001927 | A1 * | 1/2016 | Lucas, Jr. ..... B65D 83/12 206/204 |
| 2016/0031627 | A1 | 2/2016 | Yeh |
| 2016/0039955 | A1 | 2/2016 | Klein et al. |
| 2016/0318677 | A1 * | 11/2016 | Schneider ..... B65D 43/162 |
| 2019/0367247 | A1 * | 12/2019 | Romeo ..... B65D 41/485 |

FOREIGN PATENT DOCUMENTS

| | | | |
|---|---|---|---|
| CN | 105460347 | A | 4/2016 |
| EP | 0487448 | A1 | 5/1992 |
| TW | 201119918 | A | 6/2011 |
| WO | 1997032663 | A1 | 9/1997 |
| WO | 2011023920 | A1 | 3/2011 |
| WO | 2013070664 | A1 | 5/2013 |

OTHER PUBLICATIONS

Search Report issued in Singapore Patent Application No. 11202000838S, completed Mar. 9, 2021.

Written Opinion issued in Singapore Patent Application No. 11202000838S, completed Mar. 9, 2021.

* cited by examiner

MOISTURE TIGHT CONTAINERS AND METHODS OF MAKING AND USING THE SAME

CROSS-REFERENCE TO RELATED APPLICATIONS

The present application is a U.S. National Phase Application of PCT/US2018/045697, filed Aug. 8, 2018, which claims priority to U.S. Provisional Patent Application No. 62/542,358, titled "MOISTURE TIGHT CONTAINERS AND METHODS OF MAKING AND USING THE SAME" and filed Aug. 8, 2017, and U.S. Provisional Patent Application No. 62/542,391, titled "DESIGN AND PERFORMANCE OF 17 ML AND 24 ML NEXT GENERATION VIALS" and filed Aug. 8, 2017, each of which is herein incorporated by reference in its entirety.

FIELD

The disclosed concept relates generally to containers adapted to house products that are sensitive to ambient conditions, e.g., certain medications, probiotics and diagnostic test strips. The disclosed concept also relates to inserts for such containers.

BACKGROUND

The efficacy of some products, particularly in the medical field, can be adversely affected by ambient conditions, e.g., through exposure to moisture or oxygen. Medications, for example, may be compromised by moisture. As the medication absorbs moisture, the medication may become less effective for its intended purpose. Diagnostic test strips, such as blood glucose test strips that are used in diabetic care, can also be adversely affected by exposure to moisture. Likewise, it has been found that pharmaceutical administration forms comprising a living microorganism culture (e.g., probiotic microorganism), may be degraded by moisture.

Medication and diagnostic test strips can encounter moisture at multiple times in their lifecycles. Such an encounter may occur during the manufacturing stage, during shipping, while the product is in storage prior to being sold, while the product is in storage after being sold, and each and every time a container containing the product is opened so that the product can be used. Even if the medication or diagnostic test strips have been manufactured and stored in a moisture tight container, each time the container is opened so that the medication or test strips can be extracted, moisture enters the container. The moisture that enters the container surrounds the medication or test strips inside the container after the container is closed. Such exposure to moisture can adversely affect the medication or test strips and reduce shelf life.

Because a medication/test strip container is repeatedly opened and closed, and because moisture enters the container each time it is opened, it is often provided with a desiccating unit adapted to absorb moisture. The desiccating unit typically includes desiccant within a small bag or canister that comingles with the medication. Various problems may be associated with such a small bag or canister. For example, the bag/canister may be ingested by a small child, which can result in a choking hazard. Also, it is possible that the bag/canister may be thrown away after the first time the container is opened. With the bag/canister absent, there is nothing to absorb moisture as the container continues to be opened and closed each time a consumer removes products therefrom.

To address the aforementioned deficiencies associated with loose desiccant bags/canisters, desiccant entrained immovable inserts have been provided in containers. Such inserts may comprise desiccant entrained polymer formulations including a base polymer (for structure), a desiccant and optionally a channeling agent. These types of inserts and methods of making and assembling the same are disclosed, e.g., in Applicant's U.S. Pat. Nos. 5,911,937, 6,214,255, 6,130,263, 6,080,350, 6,174,952, 6,124,006 and 6,221,446, and U.S. Pat. Pub. No. 2011/0127269, all of which are incorporated by reference herein in their entireties. These desiccant inserts provide distinct advantages over loosely placed desiccant bags/canisters.

One challenge with desiccant inserts relates to maximizing exposure of the insert's surface area to the air within the container to absorb moisture to a desired level of efficacy and efficiency. Typical desiccant inserts are provided in the form of a sleeve, liner or the like, having an inner surface exposed to air within the container, but an outer surface that is flush with—or integral with—the inner surface of the container body. As such, only approximately half of the outer surface of the insert is in contact with air inside the container. While desiccant inserts are typically designed to promote communication of moisture in the air to desiccant within the insert (e.g., via channels made by channeling agents in the desiccant entrained polymer), limiting surface contact of the air to only the inner surface of the insert may not provide optimal moisture absorption activity. In addition, for some applications it may be desirable to use channeling agents that provide slower moisture uptake rates, because they may provide other desirable properties. In such circumstances, providing only the inner wall of the insert as exposed surface area to moisture may provide insufficient moisture absorption capacity for some applications.

A drawback to desiccant inserts is the added cost of such insert to the total manufacturing cost. An improved seal would translate to a reduced volume of desiccant needed to achieve the same calculated moisture budget and thus a container which is less expensive to manufacture.

On the other hand, the seal itself should not significantly add to the cost of making the container or else the cost savings through reduced desiccant use would be cancelled out. Additionally, the seal itself must be carefully designed so that it does not require significant force to open while at the same time not be too easy to open such that the container could inadvertently pop open, e.g., due to pressure changes that may occur during transport. Hence, in the pharmaceutical and diagnostics packaging business it is important to balance product improvements with manufacturing efficiencies and cost realities.

SUMMARY

There is thus a need for improved containers for pharmaceutical or diagnostic test strip use which are inexpensive to make and provide a reliably moisture-tight sealing effect during and after several cycles of opening and closing, without requiring high opening forces to open. There is also a need for an improved desiccant inserts that increase surface area contact of the desiccant entrained polymer that may be exposed to air within the container, thus minimizing the amount of desiccant needed. The presently disclosed technology achieves the above and other objectives.

Accordingly, in one aspect, a method for storing and preserving moisture sensitive products, optionally diagnostic test strips, is provided. The method includes providing a moisture tight container which comprises a polymeric material, the container having an internal volume of 12 mL to 30 mL. The container includes a container body having a base and a sidewall extending therefrom, the body defining an interior, the body further having an opening leading to the interior. The container includes a lid that is connected to the body by a hinge and that is pivotable about the hinge with respect to the container body to move the container between a closed position in which the lid covers the opening so as to create a moisture tight seal with the body and an open position in which the opening is exposed. An insert is secured, optionally fixedly secured, within the interior of the container body, the insert comprising a base material and a desiccant. The base material provides structure to the insert and is optionally a polymer. The insert has an insert opening leading to an interior compartment configured for housing products. The method additionally includes disposing a plurality of moisture sensitive products, optionally diagnostic test strips, into the interior compartment when the container is in the open position. The method further includes moving the container into the closed position, thereby creating a moisture tight seal between the lid and the body. The container provides a shelf life to the moisture sensitive products of at least 12 months, optionally at least 18 months, optionally at least 24 months, optionally 18 months to 36 months. The container, when in the closed position, has a moisture vapor transmission rate, at ambient conditions of 30° C. and 75% relative humidity (RH), of less than 500 μg/day, optionally less than 400 μg/day, optionally less than 350 μg/day, optionally less than 325 μg/day, optionally less than 300 μg/day, optionally from 150 μg/day to 300 μg/day, optionally 175 μg/day to 285 μg/day; and the insert is under 3.25 g in mass, optionally 1.5 g to 3 g, optionally 1.5 g to 2.75 g, optionally 1.75 g to 2.75 g, optionally 2 g to 2.75 g, optionally about 2.5 g.

In another aspect, a moisture tight container having an internal volume of 12 mL to 30 mL is provided.

In another aspect a process is provided for manufacturing a group of at least forty (40) moisture tight flip-top vials, wherein each group consists of 17 mL vials or 24 mL vials. The process achieves relatively low moisture ingress with relatively narrow standard deviation from a mean moisture ingress. Optionally, the median ingress at 30° C./75% RH is 159 micrograms for a 17 mL vial and 195 micrograms for a 24 mL vial.

BRIEF DESCRIPTION OF THE DRAWINGS

The foregoing summary, as well as the following detailed description of the presently disclosed technology, will be better understood when read in conjunction with the appended drawings, wherein like numerals designate like elements throughout. For the purpose of illustrating the presently disclosed technology, there are shown in the drawings various illustrative embodiments. It should be understood, however, that the presently disclosed technology is not limited to the precise arrangements and instrumentalities shown. In the drawings.

DETAILED DESCRIPTION OF THE PREFERRED EMBODIMENTS

Figure 1:
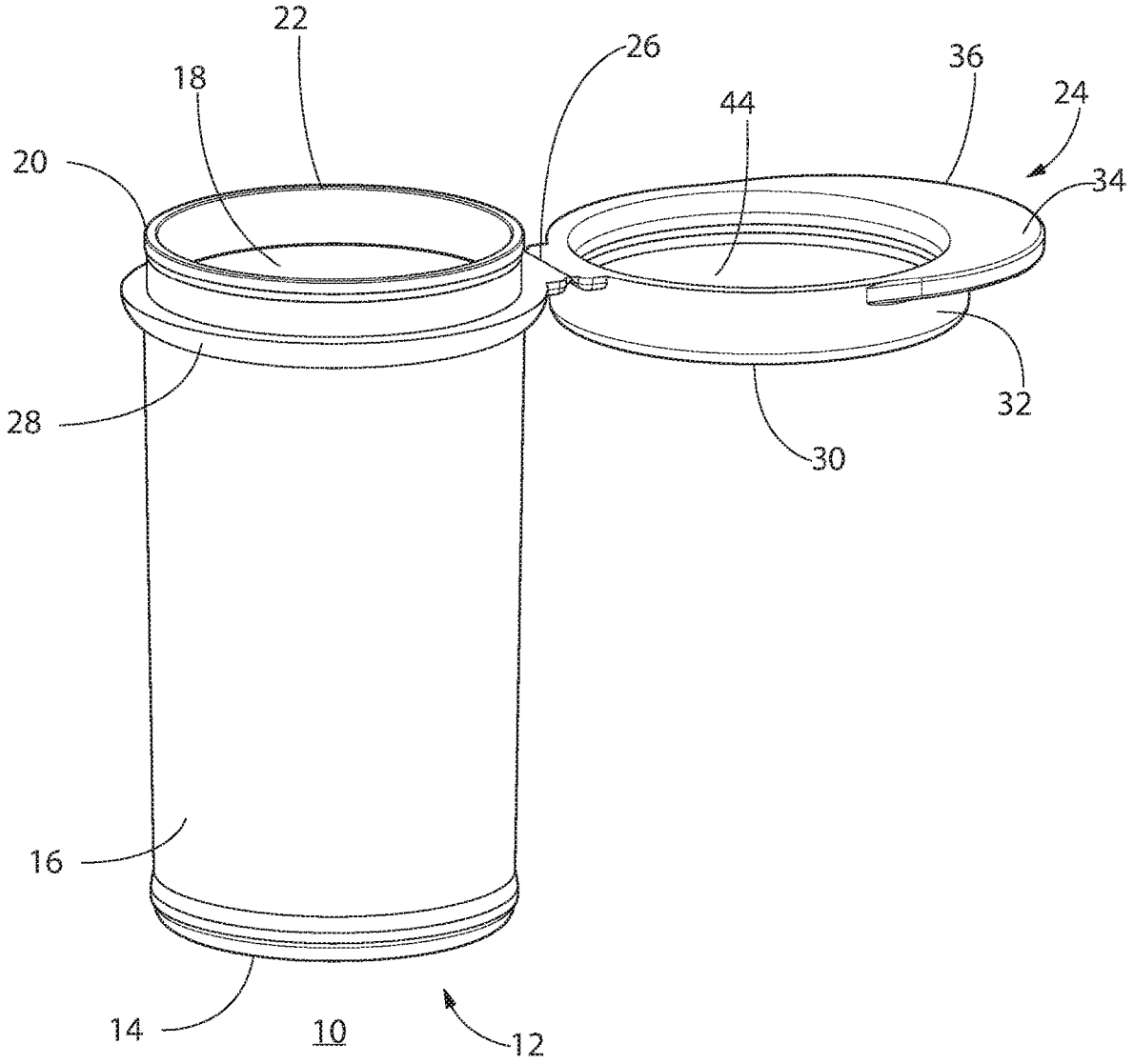
FIG. 1 is a perspective view of a container in accordance with an exemplary embodiment in an opened position.

While systems, devices and methods are described herein by way of examples and embodiments, those skilled in the art recognize that the presently disclosed technology is not limited to the embodiments or drawings described. Rather, the presently disclosed technology covers all modifications, equivalents and alternatives falling within the spirit and scope of the appended claims. Features of any one embodiment disclosed herein can be omitted or incorporated into another embodiment.

Any headings used herein are for organizational purposes only and are not meant to limit the scope of the description or the claims. As used herein, the word "may" is used in a permissive sense (i.e., meaning having the potential to) rather than the mandatory sense (i.e., meaning must). Unless specifically set forth herein, the terms "a," "an" and "the" are not limited to one element but instead should be read as meaning "at least one." The terminology includes the words noted above, derivatives thereof and words of similar import.

Generally, in one embodiment the presently disclosed technology is directed to containers and methods for making the same for reducing the amount of moisture that enters a container between the container body and the lid that seals the body. In one aspect, the disclosed embodiments are configured to reduce the amount of moisture that can flow between the body and the lid by providing at least two seals in series, wherein one such seal is formed by an elastomer-to-thermoplastic interface, which uniquely does not increase force needed to open the container. As used herein, the term "elastomer" is to be understood in its broad sense.

In one embodiment, a particularly preferred elastomer is a thermoplastic elastomer (TPE), optionally one having a Shore A hardness of from 20 to 50, preferably from 20 to 40, more preferably from 20 to 35. Alternatively, the term "elastomer" may include silicone rubbers or other preferably injection moldable soft and resilient materials appropriate for creating a compression seal against a harder (e.g., thermoplastic) surface. In any embodiment, the elastomer should be configured for repeated use, i.e., should not degrade over several cycles (e.g., at least 10, preferably at least 25, more preferably at least 50 cycles) of opening and closing.

Optionally, the presently disclosed technology relates to a container produced in a two- or multi-shot injection molding process wherein the elastomeric seal is produced in one shot and the thermoplastic container is produced in another, subsequent shot. Container embodiments as disclosed herein can incorporate a hinged flip-top lid, wherein the body and lid include therebetween a low mass elastomer-to-thermoplastic seal working in series with a thermoplastic-to-thermoplastic seal between the body and lid. The combined seals further reduce moisture vapor transmission into the container when closed than either seal alone, allowing for longer shelf life protection while still enabling the container to have a low opening force to benefit consumer use.

Optionally, the presently disclosed technology relates to a desiccant insert for absorbing moisture which enters the container via any of the seal, the container walls, and the opening when the lid is opened. In one embodiment, the insert can be formed of an active polymer solution, a scavenger, such as an oxygen scavenger, a releasing agent, or an antimicrobial material. Optionally, the insert can used for adsorption or desorption.

The external container is constructed of two materials, namely (primarily) a base thermoplastic (e.g., polypropylene) and an elastomer, preferably a thermoplastic elastomer (TPE) as one sealing surface of the invention. In one embodiment, the container has an integrated lid connected to the body by a hinge, optionally a living hinge, which is designed to be easily opened and closed by the consumer. However, the presently disclosed technology is not limited to inclusion of a hinge, as that feature could be omitted. By nature of the material selection and thermoplastic-to-thermoplastic seal design, the container has a low moisture vapor transmission rate (MVTR). This container also incorporates an elastomer material to create an additional elastomer-to-thermoplastic seal to further reduce the MVTR. By further reducing the MVTR, the container requires less moisture protection via any method of desiccation to achieve a targeted shelf life. The combination of seals allows the container to provide a lower MVTR than an otherwise comparable reference container having only thermoplastic-to-thermoplastic sealing, and at the same time allows for a lower opening and closing force than would be expected when using a thermoplastic-to-elastomer seal alone. In addition, the low mass of elastomer material will still allow the recycle/re-use of the external container material in a container production process.

A thermoplastic hinge flip-top container in accordance with an exemplary embodiment of the disclosed concept is constructed of materials with a low vapor transmission rate, e.g., polypropylene. In addition, the container lid is designed with a sealing mechanism that incorporates both a thermoplastic-to-thermoplastic seal in combination with a thermoplastic-to-elastomer seal that is permanently produced optionally inside the lid seal area, optionally via multi shot injection molding. The thermoplastic-to-thermoplastic seal area may be designed with an undercut at an angle (or rounding or slope) to the center axis of the vial that is not only part of the thermoplastic-to-thermoplastic seal, but due to the geometry, also controls the opening and closing force of the vial. By having the thermoplastic-to-thermoplastic seal work in series with the thermoplastic-to-elastomer seal, the compression force necessary to be applied to the thermoplastic seal to achieve the same level of moisture ingress may, in an optional aspect of the invention, be reduced. This may facilitate reduction of opening and closing force, thus making the container easier to use for the consumer. This is particularly useful for consumer populations that may have difficulty in opening and closing containers such as patients with diabetic neuropathy, or senior citizens.

A thermoplastic-to-thermoplastic seal relies on the mating of two incompressible surfaces that must match geometrically very closely in order to provide a closing relationship (e.g., snap-fit) and to act as an effective moisture barrier. This requires sufficient compression force to mate the opposing incompressible surfaces, thus forming the seal. The effectiveness of the seal is dependent on the area of contact and the amount of air space (e.g., through microgaps or due to imperfections or wear and tear of the thermoplastic material) between the surfaces that allow moisture to pass through.

A thermoplastic-to-elastomer seal relies on one incompressible surface (the thermoplastic surface) mating with a compressible and preferably resilient surface (the elastomeric surface). This type of seal relies on generating sufficient force between the surfaces to compress the elastomer such that it "fills" any possible gaps or imperfections in the opposing incompressible surface. This pressure must be maintained at all times when the container is closed to provide moisture tightness and then overcome in order to open the container.

By combining a thermoplastic-to-thermoplastic seal in series with a thermoplastic-to-elastomer seal, the moisture vapor ingress can be reduced while still maintaining the container opening force in a range that is ergonomically advantageous to the consumer population.

In one optimal aspect of the embodiments disclosed herein, the elastomer-to-thermoplastic seal is configured and oriented such that the direction of compression of the seal is parallel with the main axis of the vial and vertical to the seal surface. This is the case whether the elastomer is on an inner portion of the vial lid, on an outer rim projecting radially from the vial body or on a top edge of the vial body disposed around the opening (or optionally two or all three of the foregoing). This way when the vial is opened and closed, the elastomer-to-thermoplastic seal is not subject to radial forces that can rub the elastomer and scarf or damage the seal (which may occur if such seal was on the side of the vial rim or on the inner skirt of the vial lid). This enables repeated openings without deteriorating performance of the elastomer-to-thermoplastic seal. This configuration enables the use of a lower durometer seal material which requires less compression force and again provides lower opening force with lower ingress rates than a reference vial that is otherwise identical but for the elastomer-to-thermoplastic seal. In addition, this configuration does not increase the opening force of the seal, unlike a stopper-type seal with a radially compressed elastomeric element.

Referring now in detail to the various figures of the drawings wherein like reference numerals refer to like parts, there is shown in FIG. 1 a container that may be used in combination with various features in order to provide exemplary embodiments of the disclosed concept. Container 10 may be made primarily from one or more injection moldable thermo-plastic materials, including, for example, a polyolefin such as polypropylene or polyethylene. According to an optional embodiment, the container may be made from a mixture comprising primarily thermo-plastic material and a very small proportion of thermoplastic elastomer material.

Container 10 includes a container body 12 having a base 14 and an optionally tubular sidewall 16 extending therefrom, the body 12 defining an interior 18 configured for housing product, e.g., diagnostic test strips. The sidewall 16 optionally terminates at a lip 20 having a top edge, the lip 20 surrounding an opening 22 of the body 12, leading to the interior 18.

A lid 24 is preferably connected to the body 12 by a hinge 26, optionally a living hinge, creating a flip-top container 10 or vial. The lid 24 is pivotable about the hinge 26 with respect to the container body 12 to move the container between a closed position (see, e.g., FIG. 4 or 5) in which the lid 24 covers the opening 22 (preferably so as to create a moisture tight seal with the body) and an open position (see, e.g., FIG. 1) in which the opening 22 is exposed.

Container body 12 may optionally include outer rim 28 that projects radially outward from the sidewall 16 and completely encircles container body 12 near a top thereof. Optionally, the lip 20 projects vertically from the rim 28. Optionally, in any embodiment, the lip 20 has a thickness approximately equal to the remainder of the sidewall 16. Optionally, in any embodiment, the lip 20 has a thickness slightly less than that of the remainder of the sidewall 16.

Lid 24 includes a lid base 30 and preferably a depending skirt 32. Lid 24 further includes a lid outer rim 34 and optionally a thumb tab 36 extending radially from the lid 24. In order to close container 10, the lid 24 is pivoted about the hinge 26 so that the lid 24 covers the opening 22 and engages respective mating sealing surfaces of the lid 24 and body 12, to place lid 24 in closed position.

Figure 2:
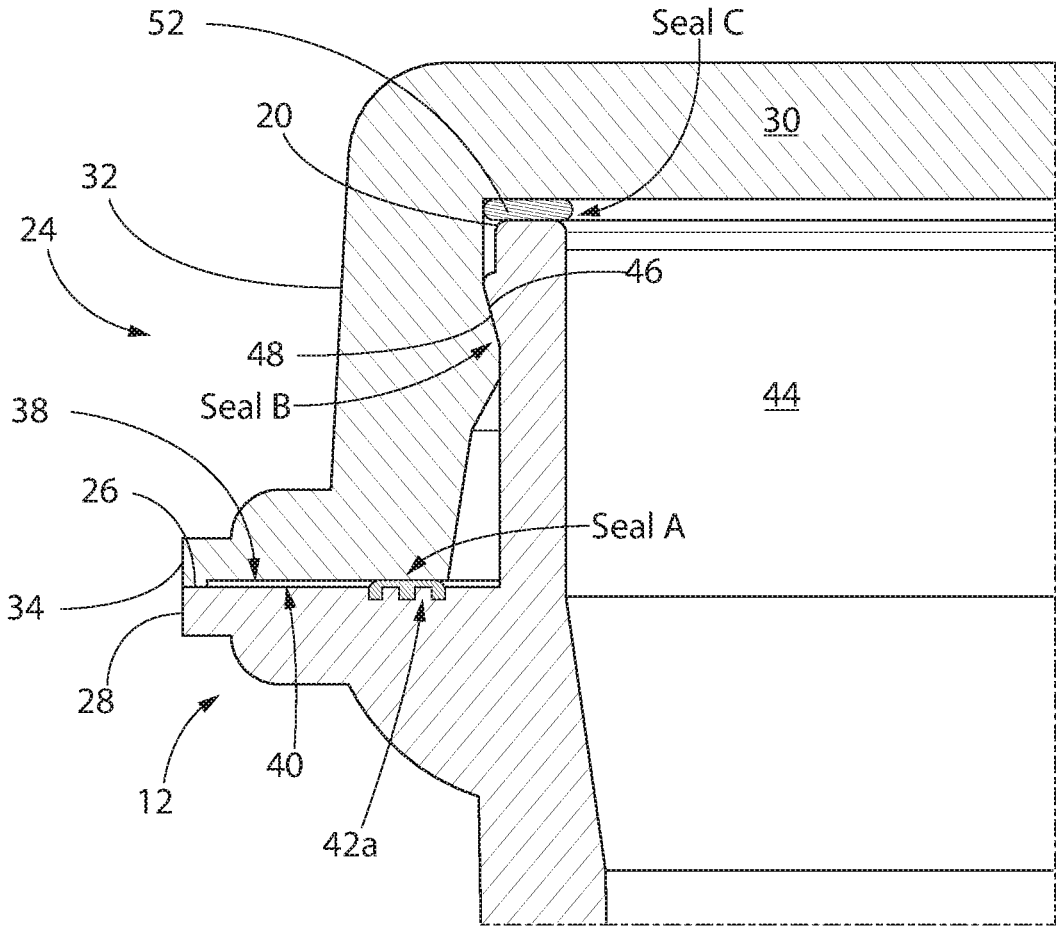
FIG. 2 is an enlarged cross-sectional view which illustrates a first variation of the exemplary embodiment of FIG. 1.

FIG. 2 is a sectional view of a container in accordance with a first variation of the exemplary embodiment of FIG. 1. Body 12 is shown near the bottom of the figure while lid 24 is shown near the top of the figure. As discussed above with respect to FIG. 1, the body 12 optionally includes outer rim 28 which projects radially about the circumference of body 12 and near the top of body 12. Lid 24 includes lid outer rim 34, optionally projecting radially from the inner portion of the depending skirt 32 of the lid 24.

When the lid 24 is in the closed position, lid rim surface 38 faces body rim surface 40. Thus, when lid 24 is in the closed position, body rim surface 40 and at least portions of lid rim surface 38 engage each other. Affixed to body rim surface 40 is elastomer seal 42*a*. The seal 42*a* is preferably an annular ring disposed around the circumference of body rim surface 40. In the illustrated exemplary embodiment, an elastomer-to-thermoplastic seal is created by elastomer seal 42*a* engaging and being compressed by lid rim surface 38.

Lid 24 includes lid interior 44, defined by lid base 30 and skirt 32. The lip 20 of body 12 extends into lid interior 44 when the lid 24 is in the closed position. In that position, body undercut surface 46 of body 12 mates with lid undercut surface 48. Accordingly, a thermoplastic-to-thermoplastic sealing surface is formed. In addition, this configuration provides a closing position, e.g., via a snap-fit mating configuration, to retain the lid 24 in the closed position and prevent it from inadvertently opening. As shown in FIG. 2, the thermoplastic-to-thermoplastic seal and the closing position are formed by respective undercut surfaces 46, 48. This may be defined, for example, with reference to an axis 50 (see FIG. 4) extending through a center of body 12 along its length. Lid undercut surface 48 and body undercut surface 46 are not parallel to that axis 50. Rather, as shown, lid undercut surface to 48 and body undercut surface 46 are formed at a slight angle, e.g., from 10° to 30° relative to the axis 50. Optionally, the respective undercut surfaces may alternatively be complimentarily rounded or sloped to mate with each other. With any such undercut configuration, if a user attempts to lift the lid 24 from body 12 to transition the lid 24 to an opened position, an opening force will be required to overcome the force between lid undercut surface 48 and body undercut surface 46 when the lid 24 is in the closed position.

In the exemplary embodiment shown in FIG. 2, lid 24 is shown as optionally including lid elastomer seal 52, which is optionally in the form of an annular ring affixed to lid base 30 adjacent to or abutting skirt 32. Thus, a seal may be formed between lid elastomer seal 52 and top edge 20. This creates an elastomer-to-thermoplastic seal between lid elastomer seal 52 and top edge 20 when the lid 24 is in the closed position. Optionally, the invention may omit either elastomer seal 52 or elastomer seal 42*a*, thus providing only a single elastomer-to-thermoplastic seal in an optional embodiment.

It is contemplated that embodiments according to aspects of the invention may include multiple and different seals in series between lid 24 and body 12. For example, the seals may comprise the seal between lid undercut surface 48 and body undercut surface 46, and the seal between elastomer seal 42*a* and lid rim surface 38. Alternatively, the two seals may comprise the seal between lid undercut surface 48 and body undercut surface 46, and the seal between lid elastomer seal 52 and top edge 20. While three seals (labeled as Seal A-C) are shown in FIG. 2, this is merely exemplary, as two seals or greater than three seals may be included in accordance with exemplary embodiments of the invention. For example, it is possible for there to be a total of three seals, more than three seals, or only two seals as explained above. Furthermore, at least one of the seals is an elastomer-to-thermoplastic seal and at least one of the seals is a thermoplastic-to-thermoplastic seal. In other words, any two (or more) of the three seals shown may be included, as long as a combination of elastomer-to-thermoplastic and thermoplastic-to-thermoplastic is included.

It should further be noted that the thermoplastic-to-thermoplastic seal provides the compression force needed to maintain the elastomer-to-thermoplastic seal. This configuration does not require that the elastomer-to-thermoplastic seal be a source of radial compressive force (e.g., as is the case with an elastomeric stopper plugged into a tube). As such, the elastomer-to-thermoplastic seal does not add to the opening force necessary to overcome the thermoplastic-to-thermoplastic seal to transition the lid 24 from the closed position to the opened position. In fact, resilience of the compressed elastomer when the lid 24 is in the closed position may result in a slight vertical spring force biasing the respective undercut surfaces 48, 46 vertically against each other, thus reinforcing or strengthening the thermoplastic-to-thermoplastic seal. Thus, if anything, such slight vertical spring force created by the elastomer-to-thermoplastic seal may tend to actually reduce the opening force compared to an otherwise identical container without an elastomeric sealing surface.

Figure 3:
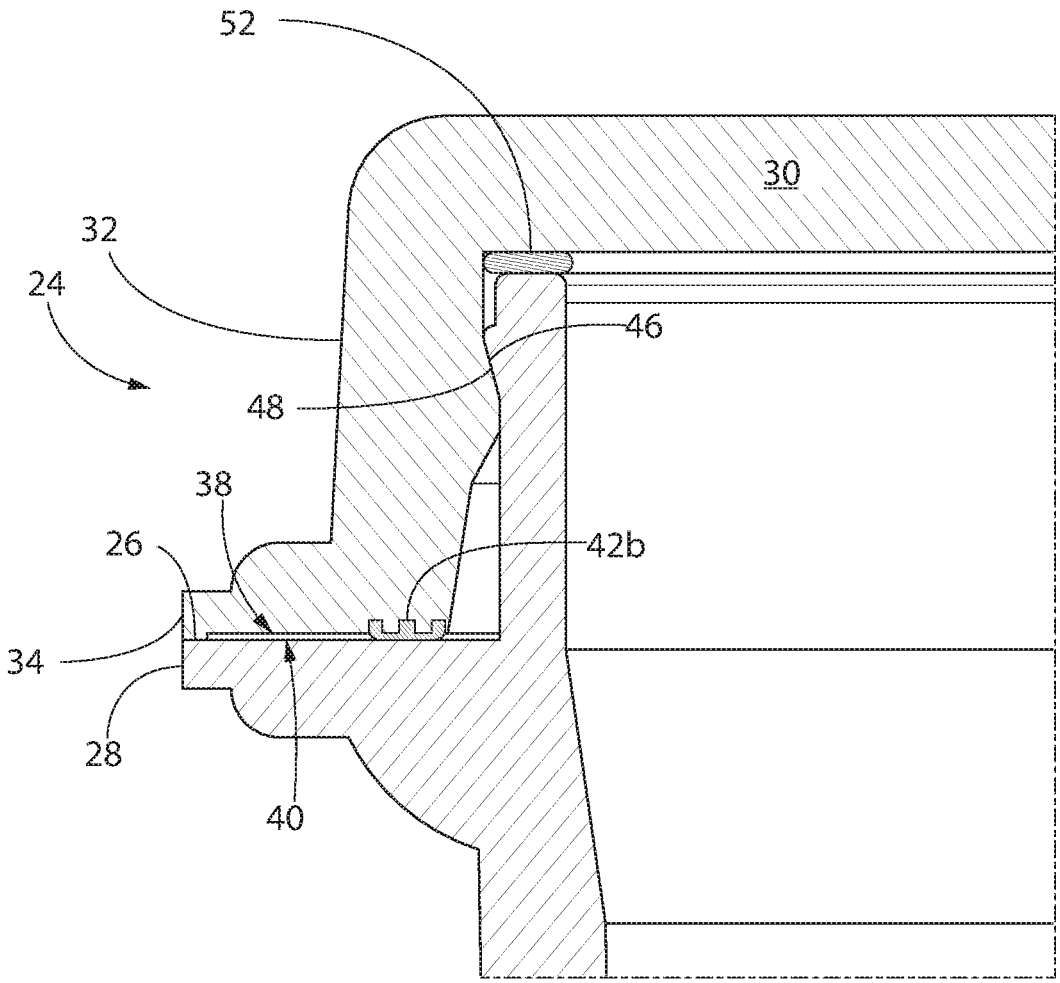
FIG. 3 is an enlarged cross-sectional view which illustrates a second exemplary embodiment of the exemplary embodiment of FIG. 1.

As discussed above with respect to the exemplary embodiment shown in FIG. 2, elastomer seal 42*a* is affixed to an upper surface of outer rim 28 of the body 12. FIG. 3 shows an alternative exemplary embodiment in which elastomer seal 42*b* is affixed to lid outer rim 34 and is in contact with outer rim 28 of body 12. In this manner, with regard to the embodiment of FIG. 2 and the embodiment of FIG. 3, an elastomer-to-thermoplastic seal is formed.

Figure 4:
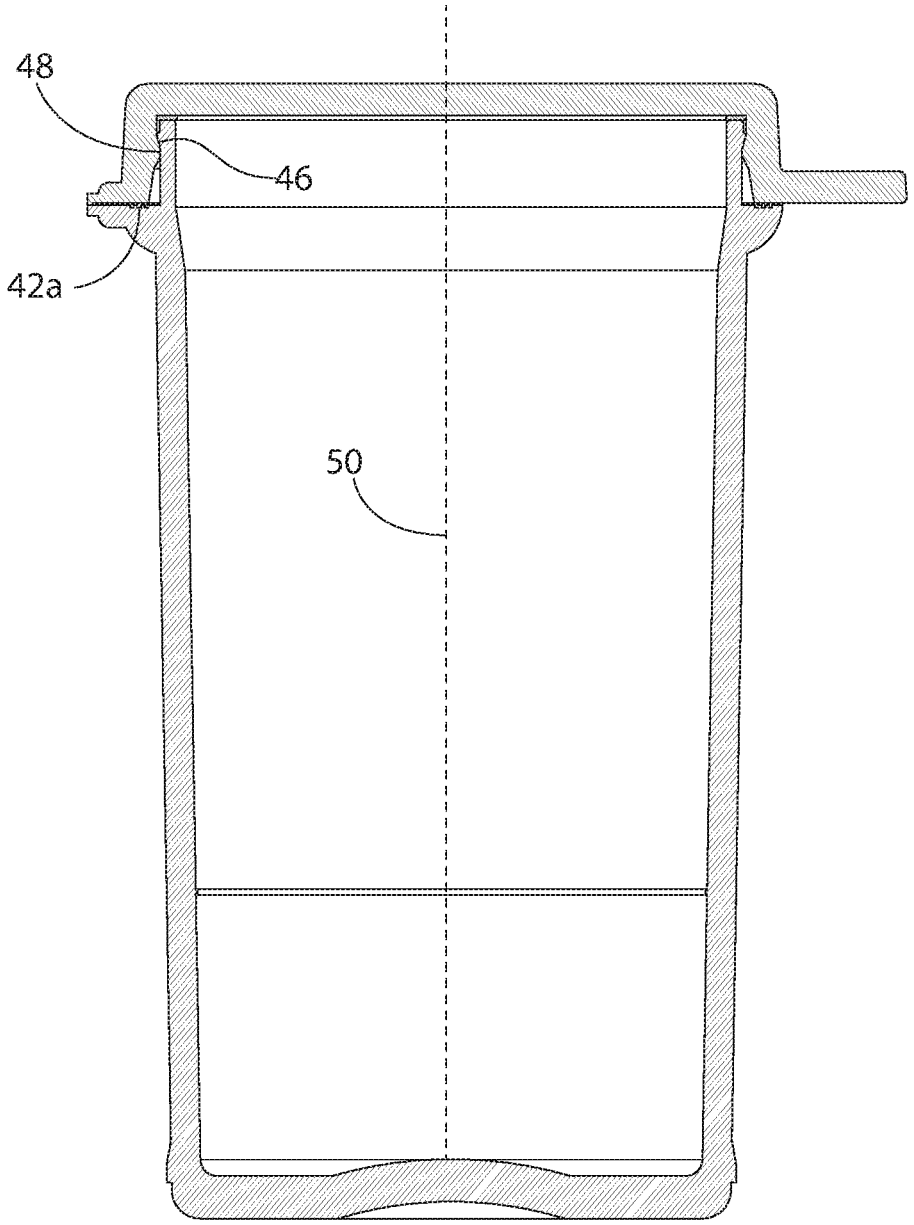
FIG. 4 is a cross-sectional view which illustrates the features of FIG. 2 and further shows additional portions of a container in accordance with the first variation of the exemplary embodiment of FIG. 1.

FIG. 4 shows the seals which are illustrated in FIG. 2 and further illustrates more of body 12 that is shown in FIG. 2. FIG. 4 is helpful for illustrating the relationship between the sealing surface that is formed between lid undercut surface 48 and body undercut surface 46 and central axis 50 which runs along the length of body 12 and through its center. As can be seen in FIG. 4, lid undercut surface 48 and body undercut surface 46 form an undercut because the seal between these two surfaces is not parallel to central axis 50. In this manner, the undercut between lid undercut surface 48 and body undercut surface 46 includes compression force vectors in both vertical and horizontal directions. The vertical compression force vector requires that an opening force be applied in order to separate lid 24 from body 12 and thus transition the lid 24 from the closed position to the opened position.

Figure 5:
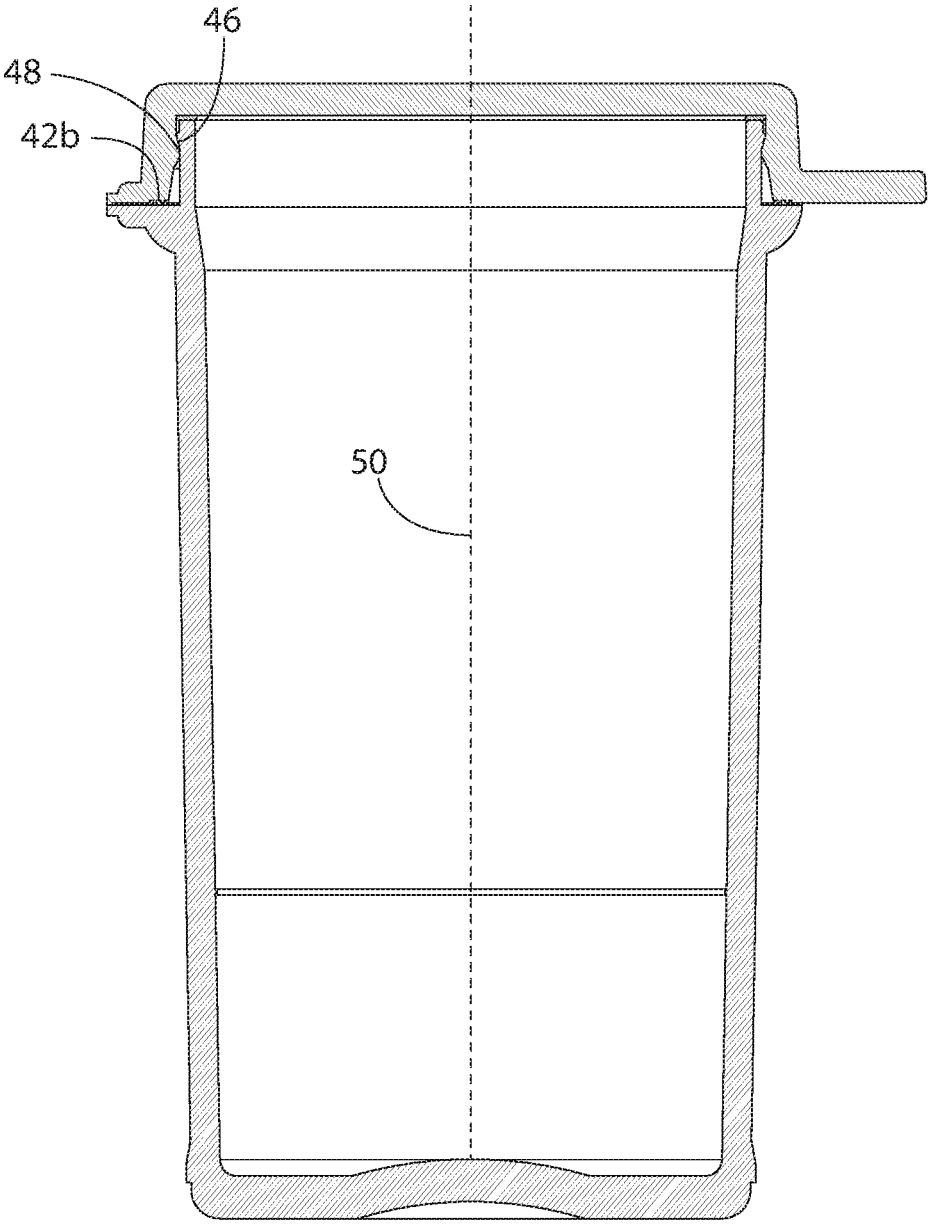
FIG. 5 is a cross sectional view which illustrates the features of FIG. 3 and further shows additional portions of a container in accordance with the second variation of the exemplary embodiment of FIG. 1.
Figure 6:
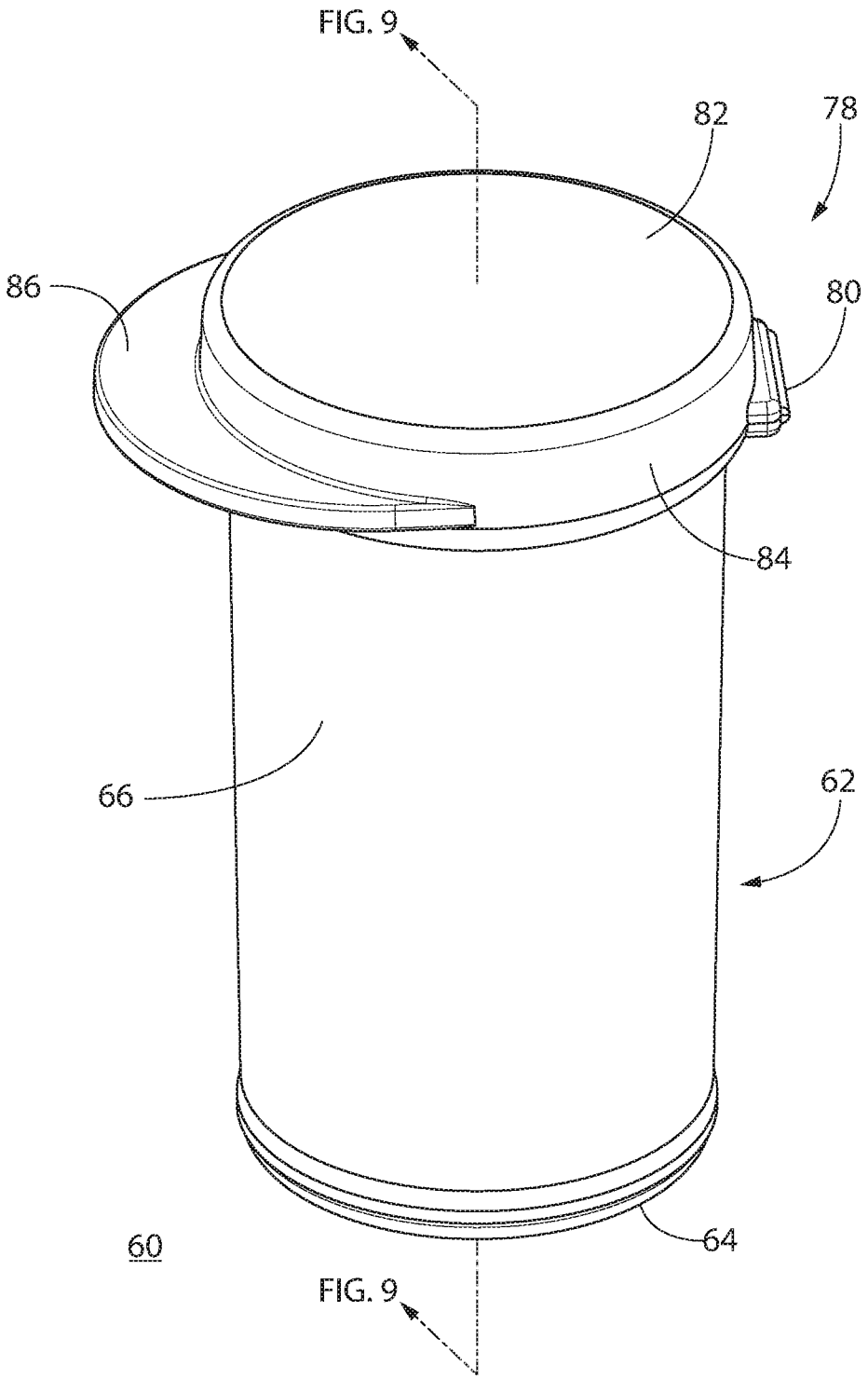
FIG. 6 is a perspective view of a container in accordance with a second exemplary embodiment in a closed position.
Figure 7:
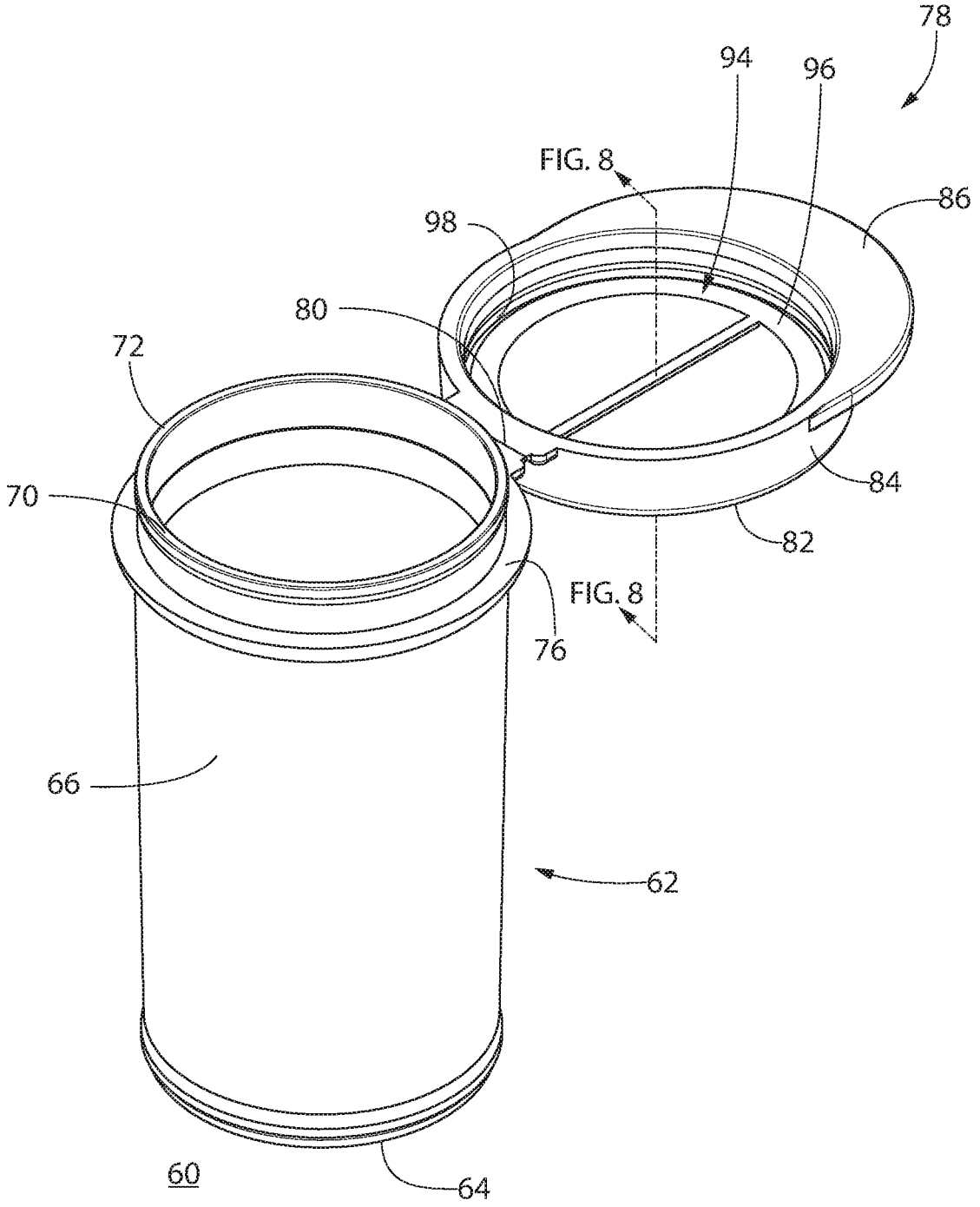
FIG. 7 is a perspective view of the container of FIG. 6 in an opened position.
Figure 8:
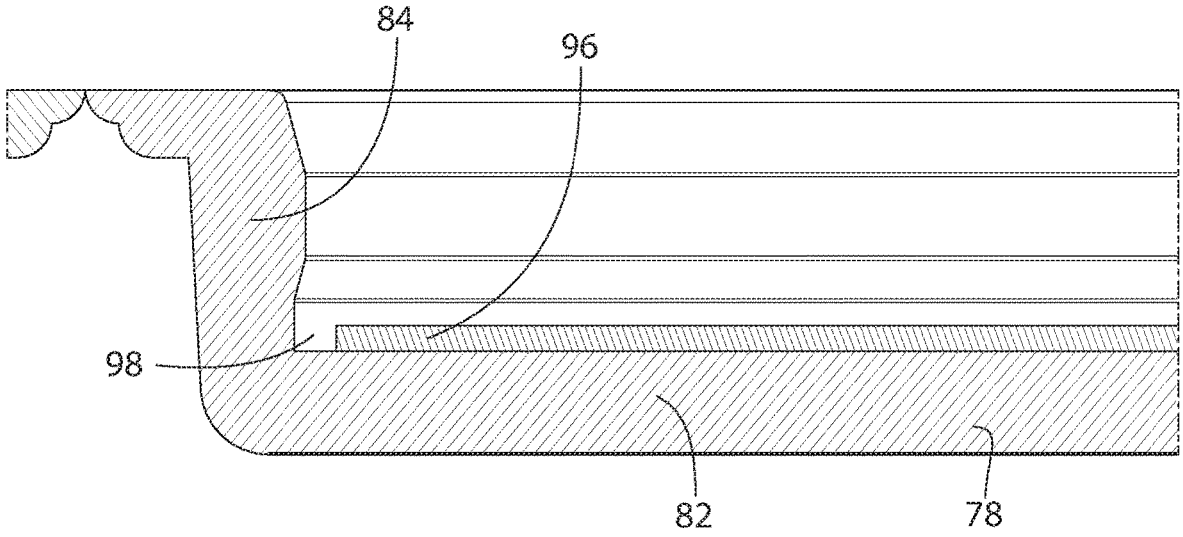
FIG. 8 is an enlarged cross sectional view taken along section line 8-8 of the container of FIG. 7 illustrating sealing surfaces in the lid.

FIG. 5 shows the seals which are illustrated in FIG. 3 and further illustrates more of body 12 that is shown in FIG. 3. FIG. 5 is also helpful for illustrating the relationship between the sealing surface that is formed between lid undercut surface 48 and body undercut surface 46 and central axis 50 which runs along the length of body 12 and through its center. The configuration and function of respective undercut surfaces 48, 46 of lid 24 and body 12 are identical to those shown in FIG. 4 and are not rehashed here for the sake of brevity.

The combination of a thermoplastic-to-thermoplastic seal in series with an elastomer-to-thermoplastic seal according to an optional aspect of the presently disclosed technology provides an MVTR through the sealing system of a maximum of optionally 42 μg/day-cm of seal circumference when the ambient conditions are a minimum of 30° C./80% relative humidity (RH) externally and a maximum of 30° C./1% RH internally, while allowing for an opening force of optionally no greater than 3 N/cm of seal circumference.

Referring now to FIGS. 6-10B, there is shown a second exemplary embodiment of a container 60 according to an optional aspect of the invention. Many features of the container 60 of FIGS. 6-10B are similar or identical to corresponding features of the container 10 of FIGS. 1-5. Therefore, only a general summary is provided here of such similar or identical corresponding features as with the previously described embodiments. However, key differences as between the embodiments and additional embellishments are noted.

Container 60 includes a body 62 having a base 64 and optionally a sidewall 66 extending from the base. The body 62 defines an interior 68. The sidewall 66 optionally terminates at a lip 70 having a top edge 72. The lip 70 surrounds an opening 74 of the body 62, leading to the interior 68. In the embodiment shown, container body 62 includes outer rim 76. The lip 70 optionally projects vertically from the rim 76.

A lid 78 is preferably connected to the body 62 by a hinge 80, optionally a living hinge, creating a flip-top container 60 or vial. The lid 78 is pivotable about the hinge 80 with respect to the container body 62 to move the container 60 between a closed position and an open position. In the embodiment shown, lid 62 includes lid base 82 and preferably a depending skirt 84 and thumb tab 86.

When the lid 78 is in the closed position, a moisture tight seal 88 (see FIG. 9) is formed by a plurality of engaged mating seals in series, including at least a first seal 90 and a second seal 92. The first seal 90 is formed by mating a thermoplastic sealing surface of the body 62 with a thermoplastic sealing surface of the lid 78. The first seal 90 is configured to require an opening force to disengage. In the optional embodiment shown, the first seal 90 comprises the engagement of undercut surface 99 of body 62 with undercut surface 97 of lid 78. This seal is identical to the undercut-to-undercut seal disclosed above with respect to the container 10 of FIGS. 1-5 and will thus not be elaborated upon further here.

Figure 9:
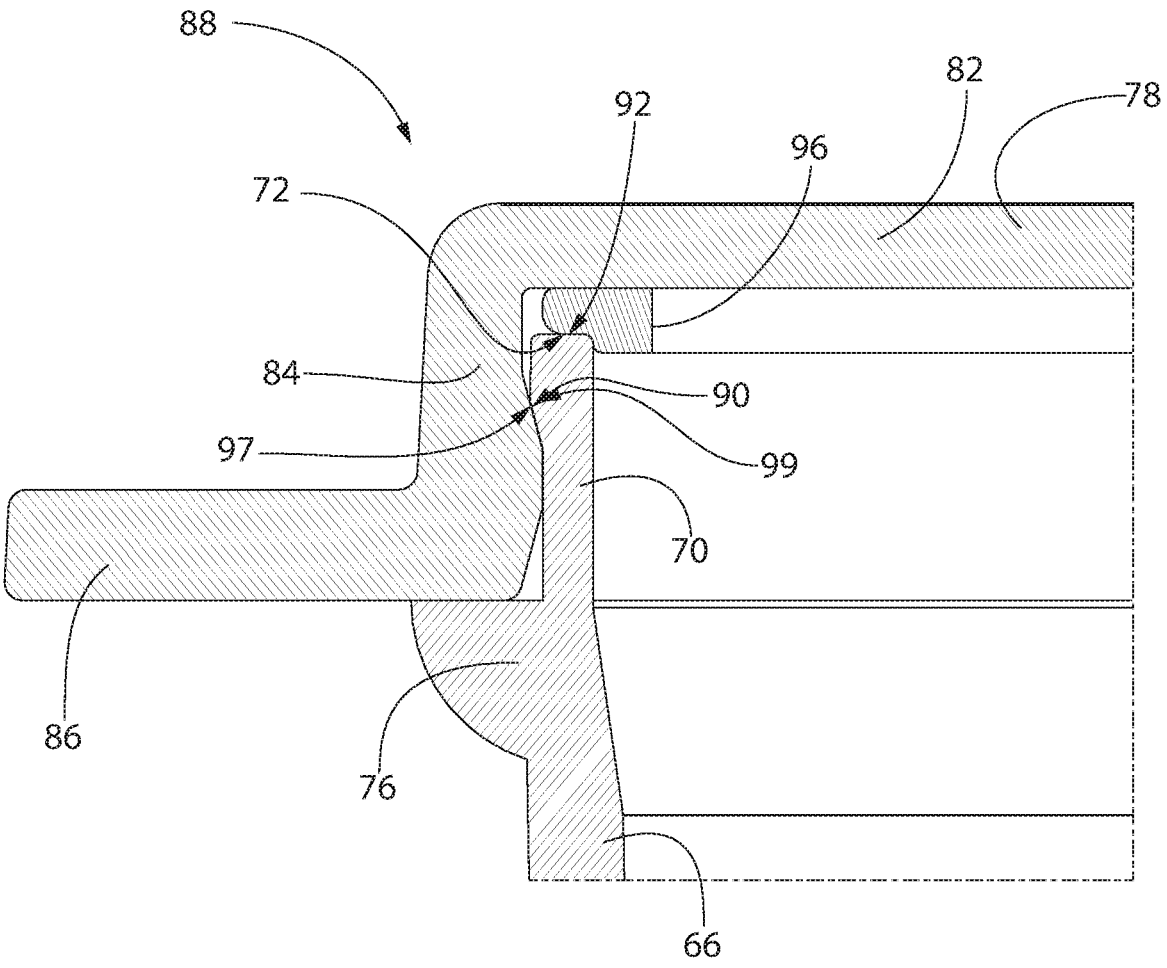
FIG. 9 is an enlarged cross sectional view taken along section line 9-9 of the container of FIG. 6 illustrating engagement of first and second seals in series to create a moisture tight seal.
Figure 10A:
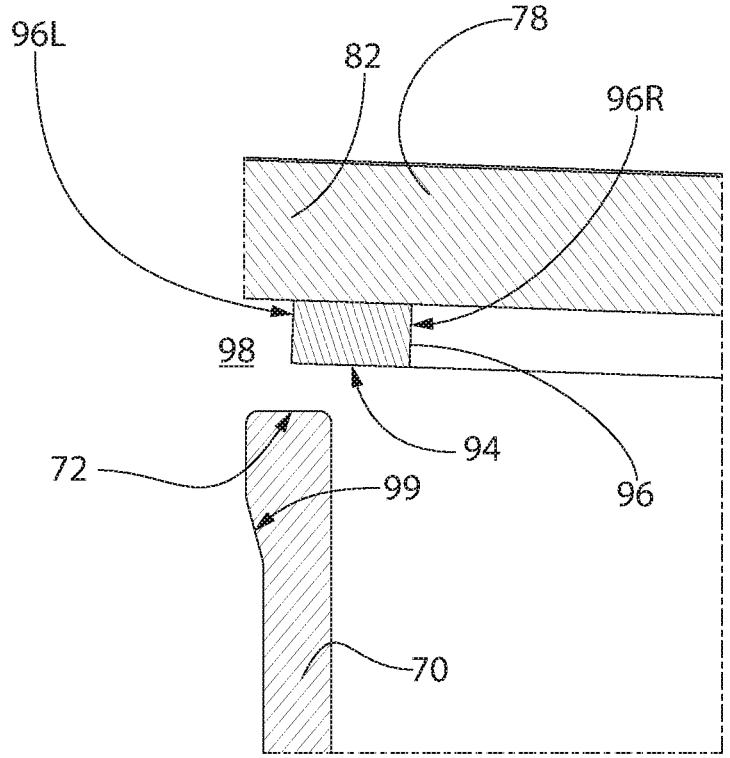
FIGS. 10A and 10B are schematic illustrations showing the elastomeric ring of the lid immediately before engagement with the thermoplastic sealing surface of the body (FIG. 10A) followed by sealing engagement of the elastomeric ring of the lid with the thermoplastic sealing surface of the body (FIG. 10B)
Figure 10B:
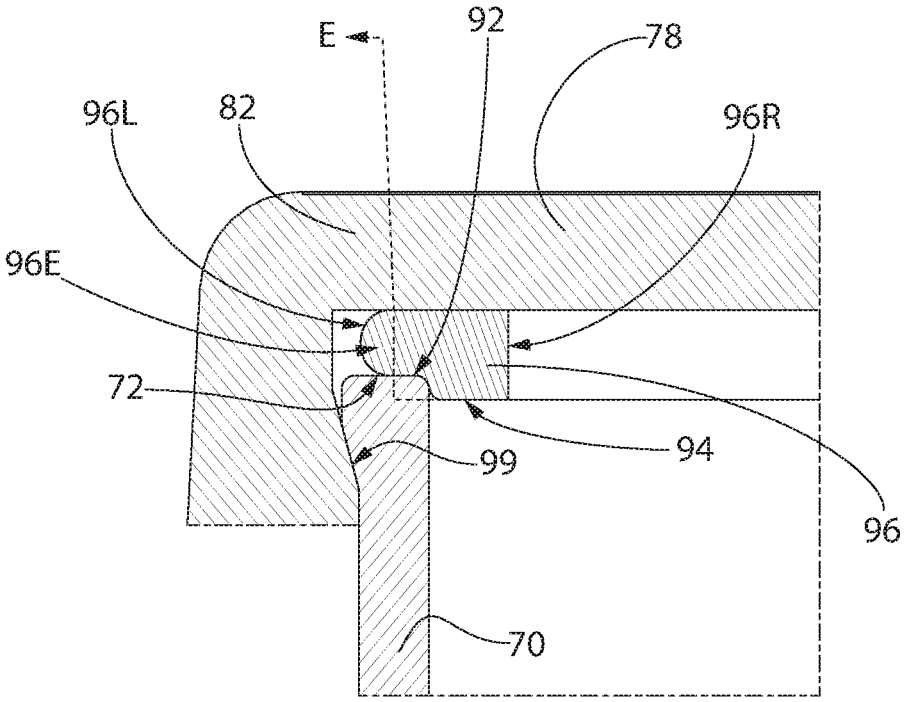

The second seal 92 is formed by mating a thermoplastic sealing surface of the body 62 or lid 78 with an elastomeric sealing surface of the body 62 or lid 78. In the optional embodiment shown, the second seal 92 is formed by mating a thermoplastic sealing surface of the body 62 with an elastomeric sealing surface of the lid 78. The elastomeric sealing surface 94 comprises an elastomeric ring 96 configured to be compressed by a thermoplastic upper surface 72 of a lip 70 surrounding the opening 74 when the lid 78 is in the closed position. As best shown in FIGS. 9-10B, vertical compression of the elastomeric ring 96 causes a portion of the ring 96 to elastically expand radially into a void 98 provided between the body 62 and the lid 78. This operation is now explained in detail.

The term "ring" as used herein can refer to an annular round element with a central opening. However, a "ring" is not necessarily limited to such configuration and could include non-round configurations as well as elastomeric elements that are filled in, at least in part, in the center (i.e., where an opening of a ring may otherwise be). As such, a "ring" could include a disc-shaped elastomeric member, for example.

FIG. 9 shows a partial enlarged cross section of the container 60 with the lid 78 in the closed position. As shown, the first seal 90 is provided, comprising the engagement of undercut surface 99 of body 62 with undercut surface 97 of lid 78. The second seal 92 comprises engagement of the thermoplastic upper surface 72 of the lip 70 with an engagement surface 94 of the elastomeric ring 96 provided on the underside of the base 82 of the lid 78. As can be seen in FIG. 9, a compression seal provided between the upper surface 72 of the lip 70 and the elastomeric ring 96 causes the cross section of the ring 96 to appear slightly stepped or indented along the engagement surface 94 of the elastomeric ring 96. This indent is more pronounced in the enlarged view shown in FIG. 10B. FIG. 10A shows the cross section of the ring 96 immediately before it contacts the upper surface 72 of the lip 70 to form the second seal. As shown in 10A, the ring 96, when not engaged with the lip, does not have such an indent. The indent in the engagement surface 94 of the elastomeric ring 96 is the product of elastomeric deformation of the ring 96 resulting from sealing engagement with the rim 70.

Notably, the elastomeric ring 96 is not bounded or blocked on either an immediate right side 96R or left side 96L thereof. As such, when the elastomeric ring 96 is compressed vertically, a portion thereof elastically expands or migrates radially outward, inward or both. A void 98 is provided, e.g., between the elastomeric ring 96 and the skirt 84 of the lid 78 to provide "living space" for the ring material to radially expand when the second seal 92 is engaged. FIG. 10B illustrates the radially expanded portion 96E of the elastomeric ring 96 (shown expanded in direction E of FIG. 10B), occupying a portion of the void 98. To the extent such expansion appears in the Figures to be exaggerated compared to actual implementation, it is merely for illustrative purposes. This radial expansion into the void feature provides at least two important functions.

First, it results in tempering the vertical spring force between the elastomer and the rim. While it is desired that some slight spring force is provided to strengthen or reinforce the first seal, excessive spring force may tend to reduce the opening force to an extent that the container may inadvertently pop open. A balance must be struck between a desirably low opening force on the one hand (especially for elderly and/or diabetic users) and an opening force that is so low that it can result in inadvertent container openings, e.g., via common pressure variations that may occur within the container during transport. When the elastomer is permitted to expand radially, the vertical spring force may thus be provided at an acceptable level.

The second important function is that the surface area of contact between the sealing surfaces of the second seal increases via radial expansion of the ring's elastomeric material. This increase of the elastomer-to-thermoplastic sealing surface area provides a tighter seal at the site of engagement of the second seal.

It should be understood that any of the seal configurations disclosed in FIGS. 1-5 may be combined with those disclosed in FIGS. 6-10B.

Optionally, in any embodiment, a flexible thermoplastic lip seal member may depend downwardly from the base of the lid to abut and thus provide a seal with the interior of the container. Such an embodiment may include some or all of the features described in U.S. Pat. No. 9,650,181, which is incorporated by reference herein in its entirety. In other words, such lip seal member abutting the interior of the container may provide an embodiment of a thermoplastic-to-thermoplastic seal within the scope of the disclosed concept. Optionally, in such an embodiment, the seal formed between the lip seal member and the interior of the container may provide the only moisture tight thermoplastic-to-thermoplastic seal for the container. Further, in such an embodiment, optionally the undercut surface of body and/or undercut surface of lid do not extend completely around the perimeter of the body/lid. Optionally, such engagement of undercuts may facilitate a closing relationship, e.g., a snap-fit configuration, but may not necessarily establish a moisture tight seal between the undercuts themselves. Alternatively, engagement of undercuts provides both a closing relationship, e.g., a snap-fit configuration, as well as a moisture tight seal between the undercuts themselves.

Ingress Performance for the seal alone is measured by taking the total vial ingress rate and subtracting out the MVTR (moisture vapor transmission rate) through the thermoplastic comprising the outer shell of the vial.

In an exemplary embodiment, when the lid is in the closed position, the moisture vapor transmission rate MVTR is less than 370 μg/day at 30° C./80% RH (relative humidity). In an exemplary embodiment of a 24 ml vial according to embodiments of the invention, the weight of a desiccant entrained three phase polymer sleeve is 2.5-3.25 grams (optionally about 3.0 g) and the moisture ingress is about 400 micrograms per day at 30° C./70% RH. In an exemplary embodiment of a 17 ml vial according to embodiments of the invention, the weight of a desiccant entrained three phase polymer sleeve is 2.0-2.75 grams (optionally about 2.5 g) and the moisture ingress is about 300 micrograms per day at 30° C./70% RH. This is a surprising improvement over prior vials which require a 6.3 g desiccant sleeve to provide adequate shelf life to test strips.

It should be noted that nominal volumetric measurements with reference to diagnostic test strip vials are approximate and generally understood in the industry. For example, a "17 mL" vial may vary slightly from that precise volumetric measurement as may a "24 mL" vial. These vial volumes are well understood in the industry. To address this issue, for some embodiments, a volumetric range is provided, e.g., a container having an internal volume of 12 mL to 30 mL.

The term "three phase polymer" refers to a desiccant entrained polymer comprising a base polymer, desiccant and channeling agent, e.g., as described in U.S. Pat. Nos. 5,911,937, 6,080,350, 6,124,006, 6,130,263, 6,194,079, 6,214,255, 6,486,231, 7,005,459, and U.S. Pat. Pub. No. 2016/0039955, each of which is incorporated herein by reference as if fully set forth. Advantageously, in an optional aspect of the invention, the second seal permits reduced use of such desiccant material, resulting in lower manufacturing costs.

In an exemplary embodiment, when the first seal and the second seal combined provide the container when the lid is in the closed position a lower MVTR than the first seal would provide without the second seal.

In an exemplary embodiment, when the first seal and the second seal combined provide the container when the lid is in the closed position a lower MVTR than the second seal would provide without the first seal.

In an exemplary embodiment of the disclosed concept, the container is used for storing diagnostic test strips.

In an exemplary embodiment of the disclosed concept, at least one of the thermoplastic-to-thermoplastic sealing surfaces is on a radially-projecting rim along an outside of the body.

In an exemplary embodiment of the disclosed concept, the elastomer has a Shore A hardness from 20 to 50, preferably from 20 to 40, more preferably from 20 to 35. A skilled person in the art of injection molding would typically avoid using TPE materials with less than 50 shore A hardness for container seals. This is because such soft TPE materials are generally difficult to adhere to the base polymer without damaging or displacing the seal during molding. However, through molding techniques that Applicants developed, use of TPE materials with a hardness of less than 50 shore A for a container seal is made possible. Use of such low durometer material creates lower resistance to flow during molding, advantageously creates lower resistance to flow during molding, enabling a thinner cross section. It is less prone to creating knit lines in the finished seal that could adversely impact seal integrity. In addition, the softer TPE material requires less compression force to seal, which reduces the likelihood of excessive vertical spring force, which could otherwise result in inadvertent opening of the container as discussed above.

In the design of a flip top container the cap opening force is a critical to quality characteristic of the product. The acceptable range of opening force is 3 to 7 lbf (pound-force) when measured by affixing the body of the vial standing on the vial base and then applying an upward force to the underside of the bill of the cap, parallel to the axis of the vial at a constant speed of 500 mm/min at a controlled temperature of 20+/−2° C., with a preferred range of 4 to 6 lbf. As discussed above, a container that is too easy to open may open inadvertently and a container with an opening force above this range may be too difficult for the user to open.

The resistance to opening under differential pressure can optionally be measured by placing a container which has been opened and closed in the ambient environment into a sealed chamber and then reducing the external pressure in the chamber over a period of 30 seconds to one minute to create a differential pressure between the interior of the container and the external environment of at least 450 mBar, which is the maximum pressure differential a container should be exposed to during commercial air transportation.

In an exemplary embodiment of the disclosed concept, the elastomer has a thickness of from 0.5 mm to 1.25 mm and optionally an exposed width of the outside vial rim is from 0 mm to 2.5 mm.

A vial in accordance with an exemplary embodiment of the disclosed concept may be recycled after use. The recycling references the primary material and the chasing arrow corresponds to that recycle class. The vial lid seal with thermoplastic elastomer is designed with a lower mass of elastomer to still allow the container to be re-used/recycled along with the primary material designation.

An additional elastomer seal thus reduces the moisture vapor transmission rate through the vial container lid seal to allow less required desiccant mass. A combination of seals working in series enables reduced moisture vapor transmission, in combination with low lid opening and closing force to optimize the consumer experience. A low mass of elastomer within the vial lid seal to allow vial re-use/recyclability of the vial's primary material.

It is noted that while exemplary embodiments are shown as round containers with round seals, the invention is not limited thereto. It is contemplated that the disclosed concept can also be utilized in the context of non-round flip-top containers to improve seal integrity between body and lid. In fact, it is contemplated that the elastomer-to-thermoplastic seals described herein would be particularly useful in enhancing seal integrity for non-round containers. For example, the first and second seals as disclosed herein may be utilized in elliptical containers, square containers, rectangular containers, quadrilateral containers with rounded corners and many other shapes. Optionally, embodiments of the disclosed concept are utilized with container shapes and configurations disclosed in U.S. Pat. Pub. No. 2011/0127269, which is incorporated by reference herein in its entirety.

It is further noted that the thermoplastic-to-thermoplastic seal (e.g., the first seal 90) is not necessarily limited to the configuration as shown in the accompanying drawing figures. For example, in an optional aspect, the thermoplastic-to-thermoplastic seal may be provided between an inner polymer ring depending from the underside of the lid base and interfacing with a portion of the inner surface of the container body wall. Optionally, in such an embodiment, an annular protrusion of the inner polymer ring engages a radial undercut within the inner surface of the container body wall to create a variation of the first seal 90 disclosed with respect to FIGS. 6-10B. This variation of the first seal would likewise require overcoming an opening force to disengage that seal.

EXAMPLES

The invention will be illustrated in more detail with reference to the following Examples, but it should be understood that the present invention is not deemed to be limited thereto.

Example 1

Tests were run to measure moisture ingress of 24 mL vials according to the container embodiment shown in FIGS. 6-10B (Group A). Ambient conditions were set at 30° C. and 80% relative humidity. There were 48 such containers in the tested population. These moisture ingress results were compared against testing data gathered from testing a population of 7553 containers (Group B) that were identical in material respects to the containers of Group A, except the containers of Group B only included the first seal (plastic-to-plastic)—not the second seal (elastomer-to-plastic). The following table shows a side-by-side comparison of the data collected.

| Group | Mean Ingress (μg/day) | Standard Deviation (μg/day) | Sample Size |
|---|---|---|---|
| A | 399.8 | 22.61 | 48 |
| B | 440.9 | 105.5 | 7553 |

As the data show, the addition of the second seal resulted in a meaningful reduction of the mean ingress and a surprisingly significant reduction in the standard deviation of moisture ingress. This significant reduction in standard deviation is notable and important from a production standpoint. Essentially, the second seal in combination with the first seal allows for a much more controlled and predictable (i.e., lower variation) moisture ingress so that container moisture budgets can be much more precisely met, resulting in fewer rejected vials. This also allows for a reduction in desiccant material necessary per vial and hence a reduction in production costs associated with the reduced amount of desiccant material.

Example 2

Tests were run to measure moisture ingress of 17 mL vials according to the container embodiment shown in FIGS. 6-10B (Group A'). Ambient conditions were set at 30° C. and 70% relative humidity. There were 144 such containers in the tested population. These moisture ingress results were compared against testing data gathered from testing a population of 2923 containers (Group B') that were identical in material respects to the containers of Group A', except the containers of Sample B' only included the first seal (plastic-to-plastic)—not the second seal (elastomer-to-plastic). The following table shows a side-by-side comparison of the data collected.

| Sample | Mean Ingress (μg/day) | Standard Deviation (μg/day) | Sample Size |
|---|---|---|---|
| A' | 305.4 | 20.54 | 144 |
| B' | 420.7 | 76.91 | 2923 |

As with Example 1, the data show that addition of the second seal resulted in a meaningful reduction of the mean ingress and a surprisingly significant reduction in the standard deviation of moisture ingress.

Example 3

Figure 26:
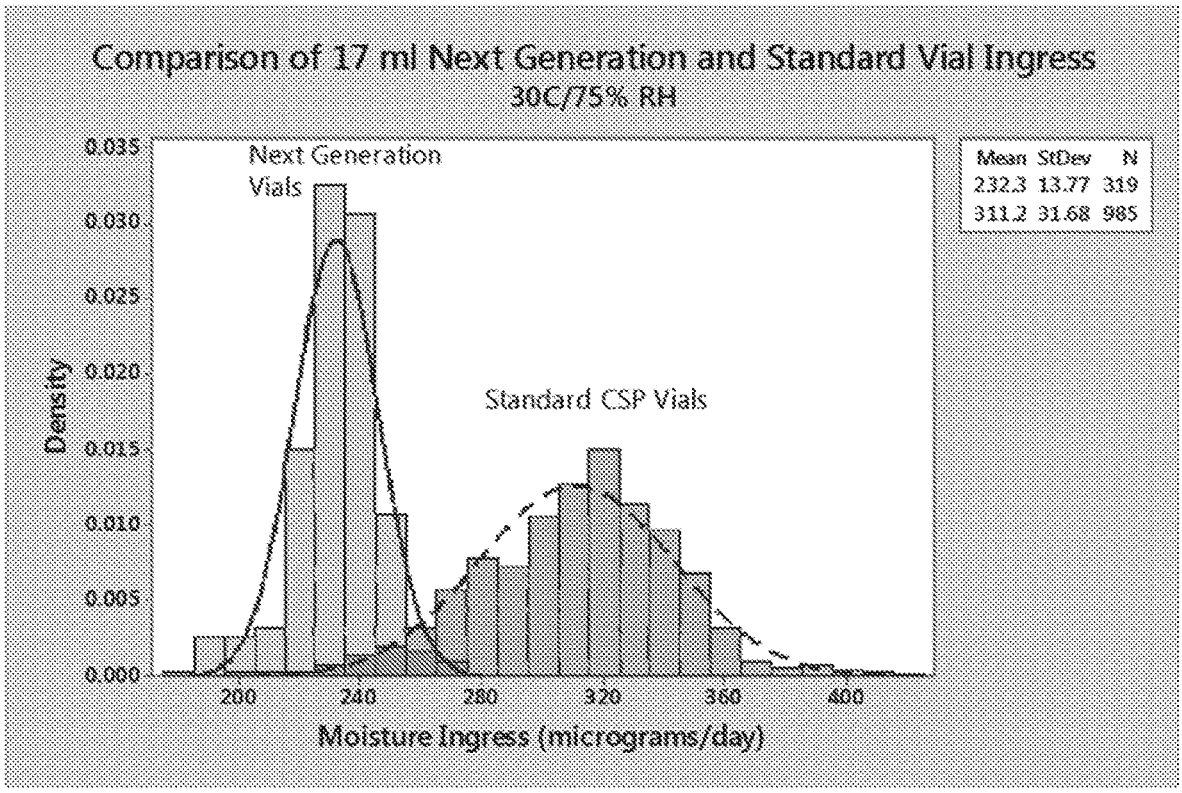
FIG. 26 is a graph and related data showing a comparison of moisture ingress (in μg/day) for a sampling of containers in accordance with a non-limiting embodiment of the disclosed concept and a sampling of containers of a prior container design.
Figure 27:
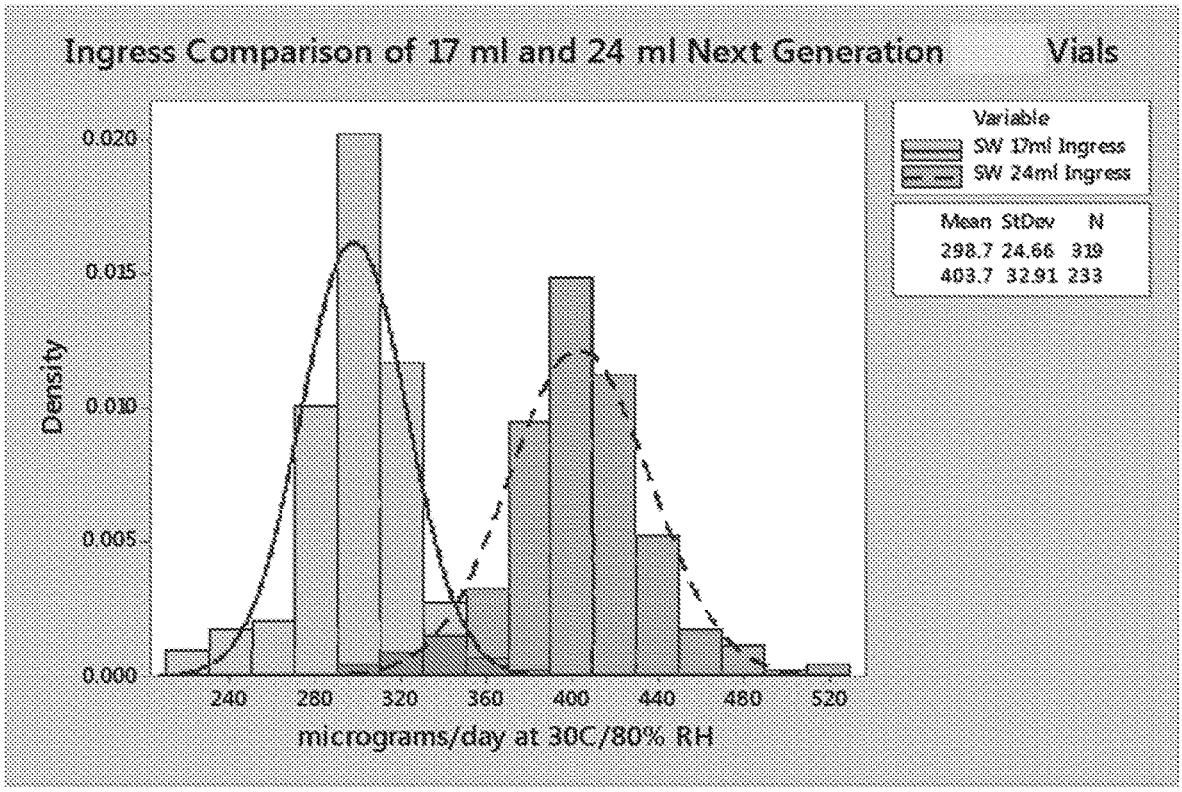
FIG. 27 is a graph and related data showing a comparison of moisture ingress (in μg/day) for a sampling of two different sized containers in accordance with a non-limiting embodiment of the disclosed concept.

Tests were run to measure moisture ingress of 17 mL vials according to the container embodiment shown in FIGS. 6-10B (Group A') with the results shown in FIG. 26. Ambient conditions were set at 30° C. and 75% relative humidity. There were 319 such containers in the tested population. As shown in FIG. 27, these moisture ingress results were compared against testing data gathered from testing a population of 985 containers of a previous design (i.e., "Standard CSP Vials)" that were identical in material respects to the containers except for the seal arrangements.

As with Examples 1 and 2, the data show that the improved seal arrangement described herein resulted in a meaningful reduction of the mean moisture ingress (i.e., 311.2 μg/day to 232.3 μg/day) and a significant reduction in the standard deviation of moisture ingress (i.e., 31.68 to 13.77).

FIG. 27 shows an additional comparison of the data similar to that of FIG. 26 except measured at 30° C./80% relative humidity) to a sampling of containers of similar design but larger volume (i.e., 24 mL capacity vs. 17 mL capacity). Comparing the data of FIGS. 26 and 27 show that mean moisture ingress and standard deviation of moisture ingress increase with increasing relative humidity and/or increasing volume.

Entrained Polymer Desiccant Inserts

One feature of the disclosed concept is directed to an insert made from an entrained active material for absorbing moisture which penetrates the container. Optionally, such feature is incorporated into a container of any of the embodiments with the sealing configurations discussed above, e.g., as shown in FIGS. 1-10B. The following definitions and examples explain aspects of such inserts and materials from which such inserts are formed.

Definitions

As used herein, the term "active" is defined as capable of acting on, interacting with or reacting with a selected material (e.g., moisture or oxygen). Examples of such actions or interactions may include absorption, adsorption (sorption, generally) or release of the selected material.

As used herein, the term "active agent" is defined as a material that (1) is preferably immiscible with the base material (e.g., polymer) and when mixed and heated with the base polymer and the channeling agent, will not melt, i.e., has a melting point that is higher than the melting point for either the base polymer or the channeling agent, and (2) acts on, interacts or reacts with a selected material. The term "active agent" may include but is not limited to materials that absorb, adsorb or release the selected material(s). Active agents according to the invention may be in the form of particles such as minerals (e.g., molecular sieve or silica gel, in the case of desiccants), but the invention should not be viewed as limited only to particulate active agents. For example, in some embodiments, an oxygen scavenging formulation may be made from a resin which acts as, or as a component of, the active agent.

As used herein, the term "base material" is a component (preferably a polymer) of an entrained active material, other than the active agent, that provides structure for the entrained material.

As used herein, the term "base polymer" is a polymer optionally having a gas transmission rate of a selected material that is substantially lower than, lower than or substantially equivalent to, that of the channeling agent. By way of example, such a transmission rate would be a water vapor transmission rate in embodiments where the selected material is moisture and the active agent is a water absorbing desiccant. The primary function of the base polymer is to provide structure for the entrained polymer. Suitable base polymers may include thermoplastic polymers, e.g., polyolefins such as polypropylene and polyethylene, polyisoprene, polybutadiene, polybutene, polysiloxane, polycarbonates, polyamides, ethylene-vinyl acetate copolymers, ethylene-methacrylate copolymer, poly(vinyl chloride), polystyrene, polyesters, polyanhydrides, polyacrylonitrile, polysulfones, polyacrylic ester, acrylic, polyurethane and polyacetal, or copolymers or mixtures thereof.

Referring to such a comparison of the base polymer and channeling agent water vapor transmission rate, in one embodiment, the channeling agent has a water vapor transmission rate of at least two times that of the base polymer. In another embodiment, the channeling agent has a water vapor transmission rate of at least five times that of the base polymer. In another embodiment, the channeling agent has a water vapor transmission rate of at least ten times that of the base polymer. In still another embodiment, the channeling agent has a water vapor transmission rate of at least twenty times that of the base polymer. In still another embodiment, the channeling agent has a water vapor transmission rate of at least fifty times that of the base polymer. In still another embodiment, the channeling agent has a water vapor transmission rate of at least one hundred times that of the base polymer.

As used herein, the term "channeling agent" or "channeling agents" is defined as a material that is immiscible with the base polymer and has an affinity to transport a gas phase substance at a faster rate than the base polymer. Optionally, a channeling agent is capable of forming channels through the entrained polymer when formed by mixing the channeling agent with the base polymer. Optionally, such channels are capable of transmitting a selected material through the entrained polymer at a faster rate than in solely the base polymer.

As used herein, the term "channels" or "interconnecting channels" is defined as passages formed of the channeling agent that penetrate through the base polymer and may be interconnected with each other.

As used herein, the term "entrained polymer" is defined as a monolithic material formed of at least a base polymer with an active agent and optionally also a channeling agent entrained or distributed throughout. An entrained polymer thus includes two-phase polymers and three phase polymers. A "mineral loaded polymer" is a type of entrained polymer, wherein the active agent is in the form of minerals, e.g., mineral particles such as molecular sieve or silica gel. The term "entrained material" is used herein to connote a monolithic material comprising an active agent entrained in a base material wherein the base material may or may not be polymeric.

As used herein, the term "monolithic," "monolithic structure" or "monolithic composition" is defined as a composition or material that does not consist of two or more discrete macroscopic layers or portions. Accordingly, a "monolithic composition" does not include a multi-layer composite.

As used herein, the term "phase" is defined as a portion or component of a monolithic structure or composition that is uniformly distributed throughout, to give the structure or composition it's monolithic characteristics.

As used herein, the term "selected material" is defined as a material that is acted upon, by, or interacts or reacts with an active agent and is capable of being transmitted through the channels of an entrained polymer. For example, in embodiments in which a desiccant is used as an active agent, the selected material may be moisture or a gas that can be absorbed by the desiccant. In embodiments in which a releasing material is used as an active agent, the selected material may be an agent released by the releasing material, such as moisture, fragrance, or an antimicrobial agent (e.g., chlorine dioxide). In embodiments in which an adsorbing material is used as an active agent, the selected material may be certain volatile organic compounds and the adsorbing material may be activated carbon.

As used herein, the term "three phase" is defined as a monolithic composition or structure comprising three or more phases. An example of a three phase composition according to the invention would be an entrained polymer formed of a base polymer, active agent, and channeling agent. Optionally, a three phase composition or structure may include an additional phase, e.g., a colorant.

Entrained polymers may be two phase formulations (i.e., comprising a base polymer and active agent, without a channeling agent) or three phase formulations (i.e., comprising a base polymer, active agent and channeling agent). Entrained polymers are described, for example, in U.S. Pat. Nos. 5,911,937, 6,080,350, 6,124,006, 6,130,263, 6,194,079, 6,214,255, 6,486,231, 7,005,459, and U.S. Pat. Pub. No. 2016/0039955, each of which is incorporated herein by reference as if fully set forth.

Exemplary Entrained Polymers

An entrained material or polymer includes a base material (e.g., polymer) for providing structure, optionally a channeling agent and an active agent. The channeling agent forms microscopic interconnecting channels through the entrained polymer. At least some of the active agent is contained within these channels, such that the channels communicate between the active agent and the exterior of the entrained polymer via microscopic channel openings formed at outer surfaces of the entrained polymer. The active agent can be, for example, any one of a variety of absorbing, adsorbing or releasing materials, as described in further detail below. While a channeling agent is preferred, the invention broadly includes entrained materials that optionally do not include channeling agents, e.g., two phase polymers.

In any embodiment, suitable channeling agents may include a polyglycol such as polyethylene glycol (PEG), ethylene-vinyl alcohol (EVOH), polyvinyl alcohol (PVOH), glycerin polyamine, polyurethane and polycarboxylic acid including polyacrylic acid or polymethacrylic acid. Alternatively, the channeling agent can be, for example, a water insoluble polymer, such as a propylene oxide polymerisate-monobutyl ether, such as Polyglykol B01/240, produced by CLARIANT. In other embodiments, the channeling agent could be a propylene oxide polymerisate monobutyl ether, such as Polyglykol B01/20, produced by CLARIANT, propylene oxide polymerisate, such as Polyglykol D01/240, produced by CLARIANT, ethylene vinyl acetate, nylon 6, nylon 66, or any combination of the foregoing.

Suitable active agents according to the invention include absorbing materials, such as desiccating compounds. If the active agent is a desiccant, any suitable desiccant for a given application may be used. Typically, physical absorption desiccants are preferred for many applications. These may include molecular sieves (e.g., 4 Å molecular sieve), silica gels, clays and starches. Alternatively, the desiccant may be a chemical compound that forms crystals containing water or compounds which react with water to form new compounds.

Optionally, in any embodiment, the active agent may be an oxygen scavenger, e.g., an oxygen scavenging resin formulation.

Suitable absorbing materials may also include: (1) metals and alloys such as, but not limited to, nickel, copper, aluminum, silicon, solder, silver, gold; (2) metal-plated particulates such as silver-plated copper, silver-placed nickel, silver-plated glass microspheres; (3) inorganics such as $BaTiO_3$, $SrTiO_3$, $SiO_2$, $Al_2O_3$, ZnO, $TiO_2$, MnO, CuO, $Sb_2O_3$, WC, fused silica, fumed silica, amorphous fused silica, sol-gel silica, sol-gel titanates, mixed titanates, ion exchange resins, lithium-containing ceramics, hollow glass microspheres; (4) carbon-based materials such as carbon, activated charcoal, carbon black, ketjen black, diamond powder; (5) elastomers, such as polybutadiene, polysiloxane, and semi-metals, ceramic and; (6) other fillers and pigments.

In another example, the absorbing material may be a carbon dioxide scavenger, such as calcium oxide. In the presence of moisture and carbon dioxide, the calcium oxide is converted to calcium carbonate. Accordingly, calcium oxide may be used as the absorbing material in applications where absorption of carbon dioxide is needed. Such applications include preserving fresh foods (e.g., fruits and vegetables) that give off carbon dioxide.

Other suitable active agents according to the invention include releasing materials. Such materials may comprise any suitable material that will release the selected material from the releasing material. The selected material released from the releasing material could be in the form of a solid, gel, liquid or gas. These substances can perform a variety of functions including: serving as a fragrance, flavor, or perfume source; supplying a biologically active ingredient such as pesticide, pest repellent, antimicrobials, bait, aromatic medicines, etc.; providing humidifying or desiccating substances; delivering air-borne active chemicals, such as corrosion inhibitors; ripening agents and odor-making agents.

Suitable biocides for use as releasing materials in the entrained polymers of the disclosed concept may include, but are not limited to, pesticides, herbicides, nematacides, fungicides, rodenticides and/or mixtures thereof. In addition to the biocides, active agents may also release nutrients, plant growth regulators, pheromones, defoliants and/or mixture thereof.

Quaternary ammonium compounds can also be used as releasing materials according to the invention. Such compounds not only function as surfactants, but also impart to the surface of the entrained polymer aseptic properties or establish conditions for reducing the number of microbial organisms, some of which can be pathogenic. Numerous other antimicrobial agents, such as benzalkonium chloride and related types of compounds as hexachlorophene, may also be used as releasing agents according to the invention. Other antimicrobial agents, such as chlorine dioxide releasing agents may be used.

Other potential releasing materials include fragrances, including natural, essential oils and synthetic perfumes, and blends thereof. Typical perfumery materials which may form part of, or possibly the whole of, the active ingredient include: natural essential oils such as lemon oil, mandarin oil, clove leaf oil, petitgrain oil, cedar wood oil, patchouli oil, lavandin oil, neroli oil, ylang oil, rose absolute or jasmin absolute; natural resins such as labdanum resin or olibanum resin; single perfumery chemicals which may be isolated from natural sources or manufactured synthetically, as for example alcohols such as geraniol, nerol, citronellol, linalol, tetrahydrogeraniol, betaphenylethyl alcohol, methyl phenyl carbinol, dimethyl benzyl carbinol, menthol or cedrol; acetates and other esters derived from such alcohols-aldehydes such as citral, citronellal, hydroxycitronellal, lauric aldehyde, undecylenic aldehyde, cinnamaldehyde, amyl cinnamic aldehyde, vanillin or heliotropin; acetals derived from such aldehydes; ketones such as methyl hexyl ketone, the ionones and methylionones; phenolic compounds such as eugenol and isoeugenol; synthetic musks such as musk xylene, musk ketone and ethylene brassylate.

It is believed that the higher the active agent concentration in the mixture, the greater the absorption, adsorption or releasing capacity (as the case may be) will be of the final composition. However, too high an active agent concentration could cause the entrained polymer to be more brittle and the molten mixture of active agent, base polymer and channeling agent to be more difficult to either thermally form, extrude or injection mold. In one embodiment, the active agent loading level can range from 10% to 80%, preferably 40% to 70%, more preferably from 40% to 60%, and even more preferably from 45% to 55% by weight with respect to the total weight of the entrained polymer. Optionally, channeling agent may be provided in a range of 2% to 10% by weight, preferably about 5%. Optionally, the base polymer may range from 10% to 50% by weight of the total composition, preferably from 20% to 35% by weight. Optionally, a colorant is added, e.g., at about 2% by weight of the total composition.

Container and Entrained Active Material Insert Embodiments

Figure 11:
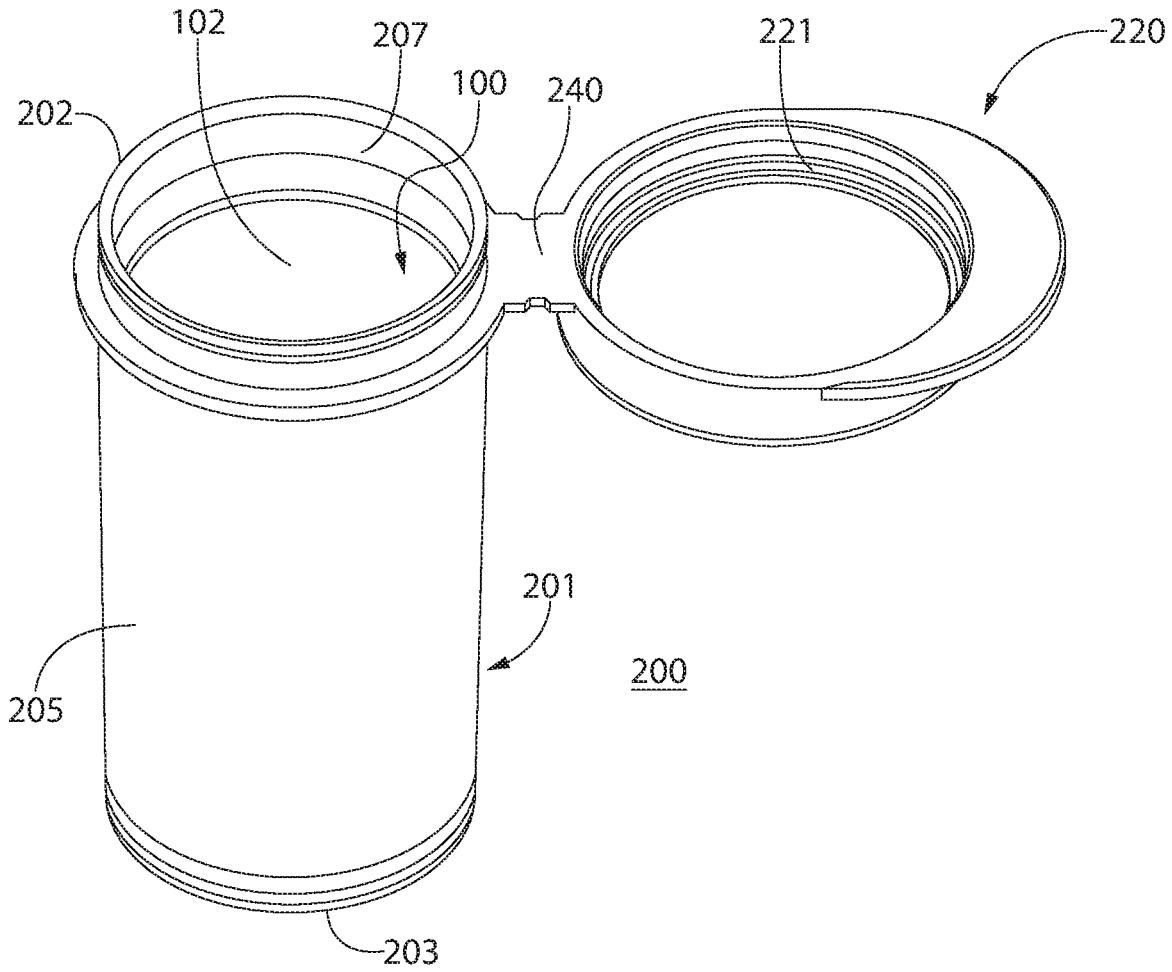
FIG. 11 is an isometric view of a container, in accordance with one non-limiting embodiment of the disclosed concept.

FIG. 11 illustrates a container 200 in accordance with one non-limiting embodiment of the disclosed concept similar to container 10 previously discussed in regard to FIG. 1. It is noted that optionally, the container 200 of FIG. 11 may incorporate any of the sealing configurations described herein with reference to FIGS. 1-10B. Container 200 includes a container body 201, optionally a lid 220, and an insert entrained with an active agent, e.g., a desiccant insert 100. The exemplary insert 100 is a desiccant insert (i.e., entrained with a desiccant as active agent). However, it should be understood that alternative active agents may be used in place of or in combination with desiccant (for example, the insert 100 may alternatively be an oxygen scavenger insert) according to optional embodiments of the disclosed concept.

In the exemplary embodiment, container body 201 and insert 100 are generally cylindrical-shaped, although other three-dimensional (length-wise) shapes are contemplated as well, including elliptical, square, rectangle, prism, etc. It should be appreciated that the insert can be any monolithic composition entrained with an active agent.

Desiccant insert 100 is comprised of a desiccant that is entrained in another material, e.g., a thermoplastic polymer. Desiccant is incorporated into desiccant insert 100 in various manners that are known to one of ordinary skill in the art. Desiccant insert 100 may be formed, for example in a single-shot injection molding process. Alternatively, desiccant insert 100 may be formed as part of a two-shot molding process in forming a container, wherein one shot forms container body 201 (and optionally lid 220) and another shot forms desiccant insert 100.

When entraining a desiccant within a rigid polymer matrix to make the insert 100, a moisture impermeable polymer encasement may be created about the individual desiccant particles contained within a structure. As described above, channeling agents, may be combined with a polymer base matrix that is used in the formation of rigid bodies. In this manner desiccant insert 100 is preferably comprised of a base polymer, the active agent (desiccant) and optionally a channeling agent (i.e., a three-phase desiccant polymer). As discussed above, in some embodiments, omission of the channeling agent may be desired, so as to provide a two-phase polymer comprising a base polymer and active agent. The base polymer into which the desiccant and (optionally) channeling agent are blended to form a monolithic composition include injection moldable thermoplastics, for example, polyethylene or polypropylene.

The desiccant and channeling agent may be added to the polymer when the polymer base is in a molten state prior to forming it into a container so that these additive agents may be blended and thoroughly mixed throughout the base polymer material. After thoroughly blending the several materials together and the mixing process is subsequently stopped, the channeling agent will separate from the polymer base and form microscopic veins or channels that act as moisture communicating passages throughout the polymer. Ethylene-vinyl alcohol (EVOH) and polyvinyl alcohol (PVOH) have been found to be particularly suited as channeling agents for some applications. Each of these alcohols may be mechanically mixed with base polymers, such as polypropylene and polyethylene, and then allowed to separate into domains while still in the molten state. The microscopic channels are open at the surface of the polymer structures and thereby provide access for moisture to interior portions of the polymer matrix.

Figure 12:
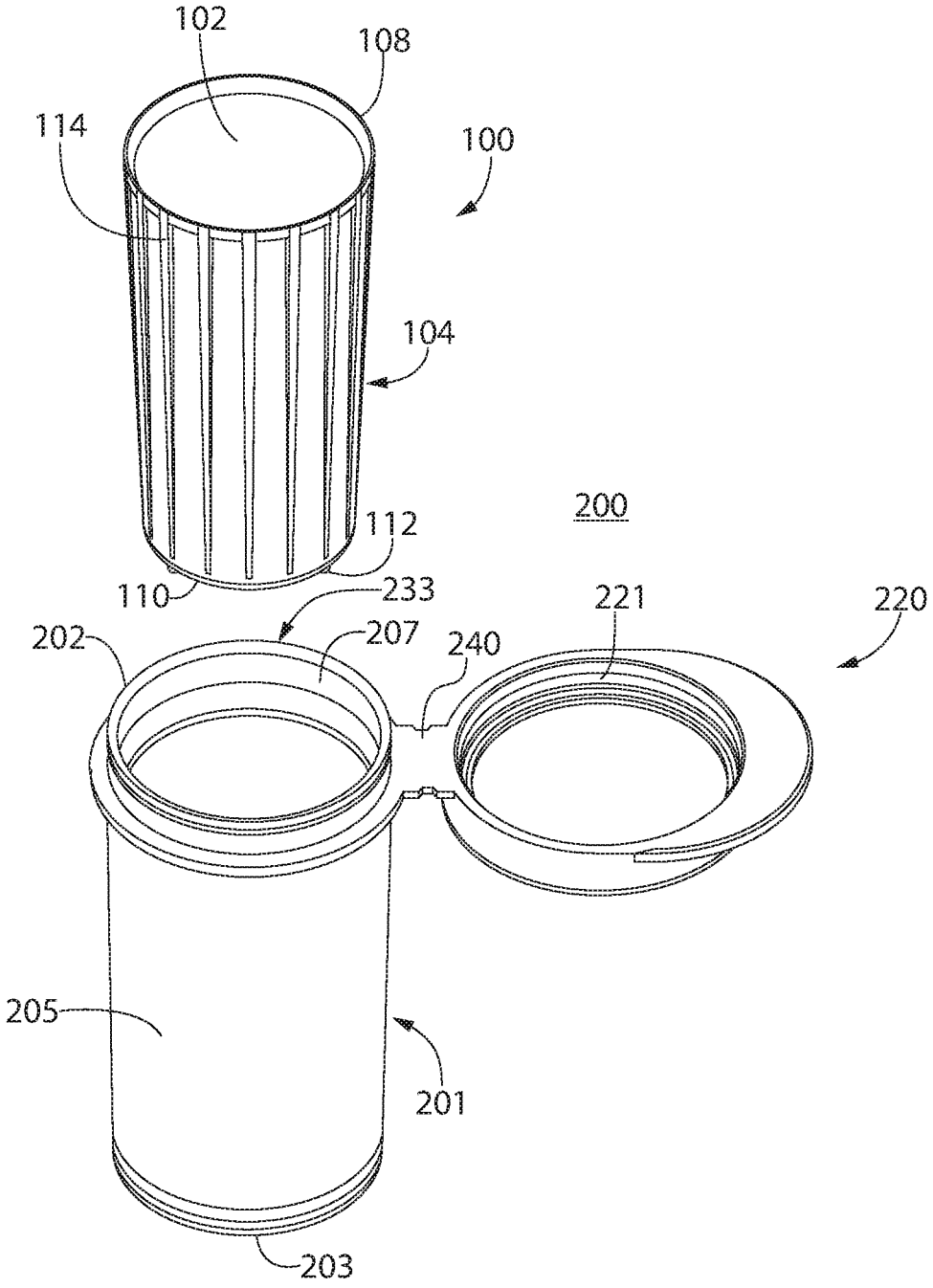
FIG. 12 is an exploded isometric view of the container of FIG. 11.
Figure 13:
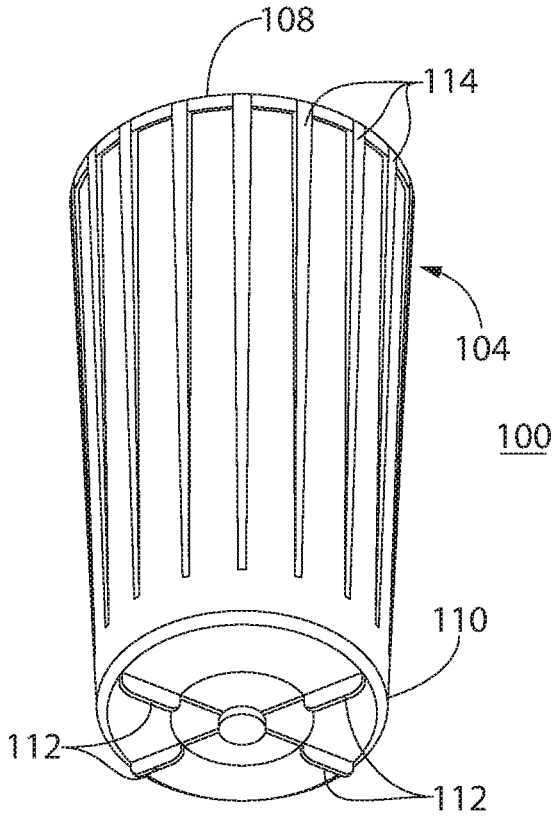
FIG. 13 is an isometric view of an insert for the container of FIG. 12.

Desiccant insert 100 is shown most clearly in FIG. 12 and FIG. 13. Insert 100 includes an opening leading to an interior compartment 102 for housing products (e.g., without limitation, medication and diagnostic test strips) and an outer surface 104. Interior compartment 102 may have a variety of shapes associated therewith including a shape that corresponds generally to the outer shape of insert 100 (e.g., cup-like). Optionally, the insert 100 is tube-like and without a bottom (not shown) in which case the interior compartment would be open on two ends instead of one. Insert 100 further has a top-edge 108 and a bottom end 110 located opposite and distal to top-edge 108. In one exemplary embodiment, top-edge 108 defines an opening leading into interior compartment 102, and bottom end 110 is generally disc-shaped. Insert 100 extends from top-edge 108 to bottom end 110. Bottom end 110 is preferably closed, with the same material used throughout insert 100. However, in some embodiments, bottom end 110 is deleted (or partially deleted) so that insert 100 is a cylinder with both ends open.

Continuing to refer to FIGS. 12 and 13, protrusion(s), e.g., without limitation, detents 112 and ridges 114, are provided on outer surface 104. Detents 112 extend from bottom end 110 away from top-edge 108 in order to create space between bottom end 110 and container body 201. Stated differently, detents 112 slightly elevate bottom end 110 from a base 203 of container body 201. By elevating bottom end 110, bottom end 110 is well exposed to air within a void between container body 201 and insert 100. In this manner, and as will be discussed below, bottom end 110 is able to absorb moisture within container body 201. As shown, ridges 114 may be a plurality of evenly spaced ridges that are situated parallel to each other and extend longitudinally from near the top-edge 108 to near the bottom end 110. In yet another embodiment, ridges 114 do not extend the entire distance from top-edge 108 to bottom end 110. Ridges 114 may extend only part of the distance or may each exist as a line of discontinuous ridges with spaces therebetween. The thickness of ridges 114 may be any of a variety of dimensions. In the example shown in FIGS. 2 and 3, ridges 114 are tapered from top-edge 108 to bottom end 110 (i.e., they are thicker towards the top of insert 100 and thinner towards the bottom of insert 100). In an embodiment in which insert 100 is assembled into container body 201 by press fit, tapering of ridges 114 may advantageously facilitate automated insertion of insert 100 into container body 201 upon which upper portions of ridges 114 establish an interference fit with container body 201.

In an exemplary embodiment, insert 100 is optionally rigid and thus not subject to deformation when minimal pressure is applied thereto. This optional rigidity may be helpful, for example, in some applications such as when insert 100 is used in combination with an outer container that is not round (and that is for example elliptical, etc.). This optional rigidity may provide support to resist deflection about sealing surfaces of non-round (e.g. elliptical) containers (which may promote moisture tightness). Non-round containers, e.g., elliptical containers, are disclosed in U.S. Pat. Pub. No. 2011/0127269, which is hereby incorporated by reference in its entirety.

Moisture tightness may be advantageous to at least partially prevent moisture from entering a container and reducing the efficacy of medicine or test strips included therein. When moisture enters a container, moisture ingress has occurred. In accordance with any embodiment of the invention, a container in which desiccant is included may be moisture tight. The term "moisture tight" with respect to a container is defined as a container having a moisture ingress rate of less than 1000 micrograms per day, at 80% relative humidity and 22.2° C. Moisture ingress may thus fall within one of several ranges. One such range is between 25 and 1000 micrograms per day under the aforementioned ambient conditions. Another such range is 50-1000 micrograms per day under the aforementioned ambient conditions. A further such range is 100-1000 micrograms per day under the aforementioned ambient conditions. Still further optional ranges include 100-450 micrograms per day, optionally 150-400 micrograms per day, optionally 150-350 micrograms per day, optionally 150-300 micrograms per day, e.g., for a container having an internal volume of 12 mL to 30 mL, under the aforementioned ambient conditions. To determine moisture ingress rate, the following test method may be used: (a) place one gram plus or minus 0.25 grams of molecular sieve in the container and record the weight; (b) fully close the container; (c) place the closed container in an environmental chamber at conditions of 80% relative humidity and 22.2° C.; (d) after one day, weigh the container containing the molecular sieve; (e) after four days, weigh the container containing the molecular sieve; and (f) subtract the first day sample from the fourth day sample to calculate the moisture ingress of the container in units of micrograms of water.

In an exemplary embodiment, it may be desirable to increase the exposed surface area of insert 100. In this manner, a larger amount of surface area of desiccant would be exposed to air in container 200 in order to facilitate absorption of moisture. Thus, it may be desirable, for example, to increase the radial depth of ridges 114. It is understood, however, that increasing the radial depth of ridges 114, while maintaining the outermost diameter of insert 100 will result in a decrease in the inner diameter of insert 100. This will accordingly be accompanied by a decrease in the surface area of interior compartment 102 and reduction of volume of the interior compartment 102 for housing products. In other words, any modification to any of the dimensions associated with insert 100 may result in an increase or decrease in exposed desiccant entrained surface area (or compartmental volume) depending on how the modification is made.

Referring to FIGS. 11 and 12, container body 201 material may be selected from a variety of different materials. Preferably, container body is made from one or more injection moldable plastic materials, e.g., polypropelene or polyethylene. Container body 201 includes base 203 and a sidewall 205 extending therefrom. Container body 201 has an inner surface 207 that defines an interior 231 of container body 201, and container body 201 further has an opening 233 leading into the interior 231.

Lid 220 is also preferably included. Lid 220 may be separable from container body 201 or preferably, it may be linked to container body 201 by a hinge 240 to form a flip-top container, as shown. In alternative embodiments, the lid may be a stopper, a screw cap, a foil seal—any structure that is configured to cover the opening.

In the flip-top container configuration shown, the lid 220 is pivotable about a hinge axis to move the container 200 between open and closed positions. Lid 220 is movable with respect to container body 201 to move container 200 between a closed position in which lid 220 covers the opening 233 of container body 201 and an open position in which the opening 233 is exposed. In order to close container 200, lid 220 is rotated via hinge 240 so that lid 220 seals container body 201. Lid 220 has at least one lid sealing surface 221 and container body 201 has at least one body sealing surface 202 located about the opening 233 leading to the interior 231 of container body 201. Body sealing surface 202 and lid sealing surface 221 are configured to mate to form a moisture tight seal between lid 220 and container body 201 when container 200 is in the closed position.

FIG. 12 illustrates desiccant insert 100 prior to being secured within container body 201. As shown, desiccant insert 100 can slide into container body 201 through the opening 233 in container body 201. The combined use of insert 100 and the illustrated container body 201 embodiment is merely exemplary. It should be understood that desiccant insert 100 may be used with other containers having various shapes, sizes, features, etc.

Figure 14:
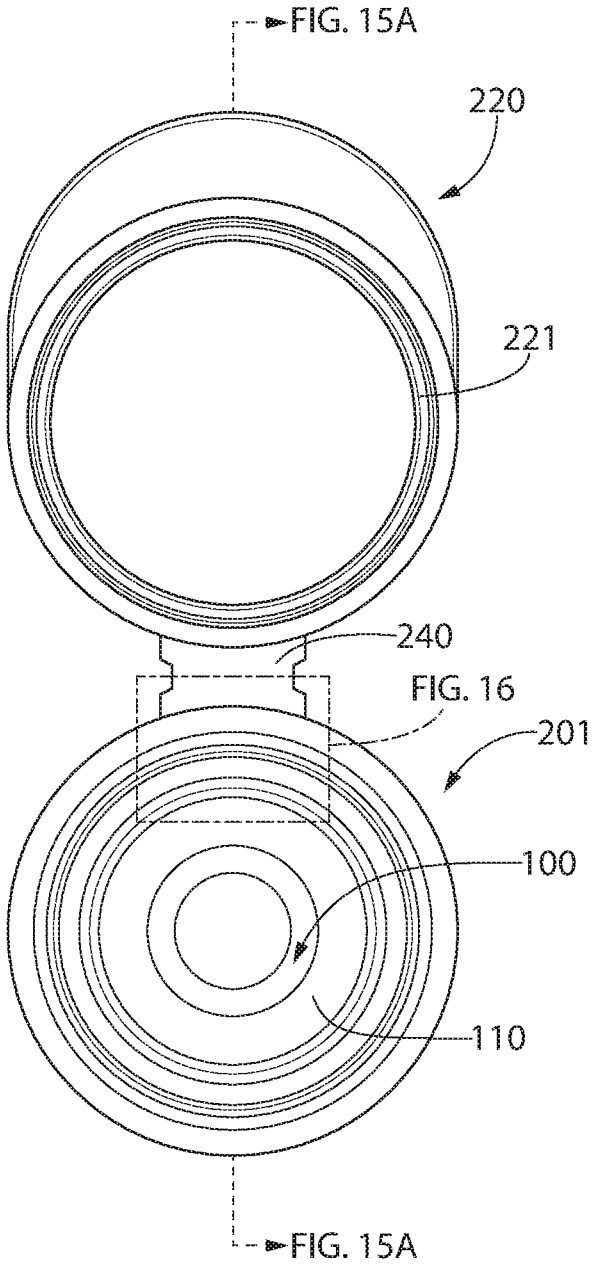
FIG. 14 is a top view of the container of FIG. 11.

FIG. 14 illustrates a top view of desiccant insert 100 after it has been inserted into container body 201. In an exemplary embodiment of the disclosed concept, it is desirable to maximize the exposed surface area of desiccant insert 100 for moisture absorption as it sits within container body 201. Therefore, as previously described, detents 112 and ridges 114 are included to establish a void between an exposed portion of the outer surface of the insert and a portion of the inner surface of container body, wherein moisture within the void may be absorbed by exposed portion of insert 100.

Figure 15A:
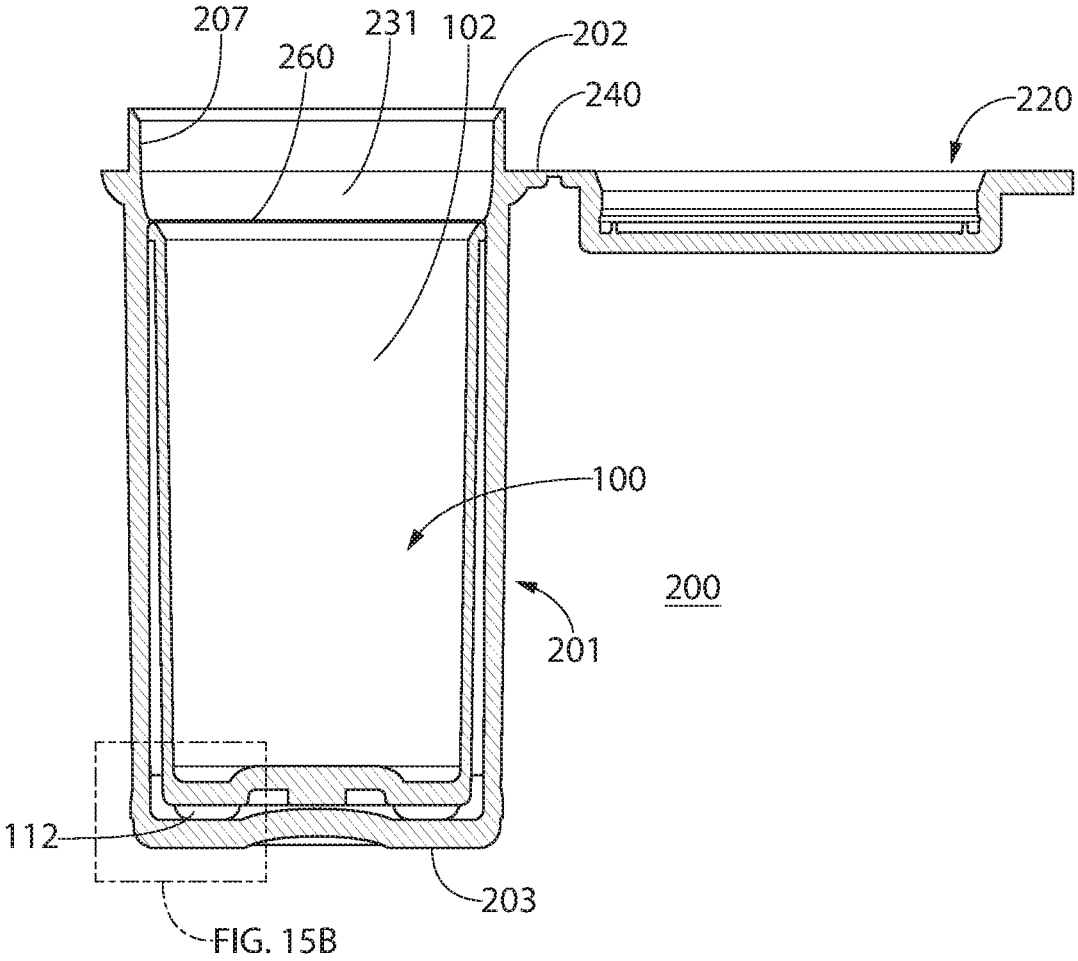
FIG. 15A is a section view of the container of FIG. 14, taken along line 15A-15A of FIG. 14.
Figure 15B:
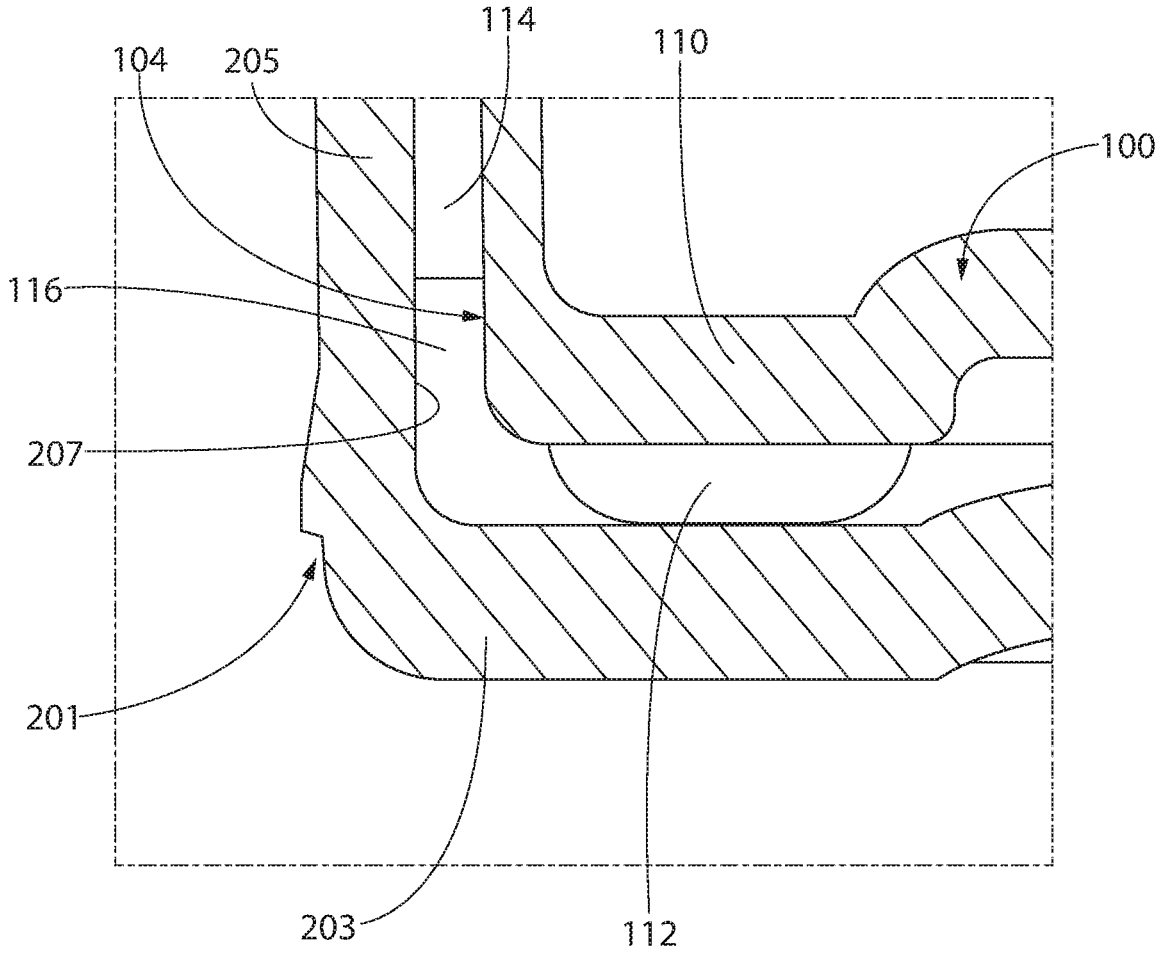
FIG. 15B is an enlarged view of a portion of the container of FIG. 15A.

FIG. 15A shows a section view of container 200 and FIG. 15B shows an enlarged view of a portion of FIG. 15A. It will be appreciated with reference to FIG. 15B that a void 116 is provided between an exposed portion of outer surface 104 of insert 100 and a portion of inner surface 207 of container body 201. Void 116 is created by virtue of the engagement between detents 112 and ridges 114 with inner surface 207 of container body 201.

As shown in FIG. 15A, container body 201 may include an annular-shaped retention ring 260 extending radially inwardly from inner surface 207 of container body 201 in order to retain insert 100 within container body 201. Retention ring 260 extends slightly beyond the outermost diameter of desiccant insert 100, so that retention ring 260 maintains desiccant insert 100 within container body 201. In one embodiment, retention ring 260 extends a sufficient amount so that desiccant insert 100 does not fall out of container body 201 when container 200 is inverted and open. In another embodiment, retention ring 260 extends a sufficient amount so that even when manual force (i.e. greater than gravitational force) is applied, desiccant insert 100 is prevented from sliding out of container 200.

Figure 16:
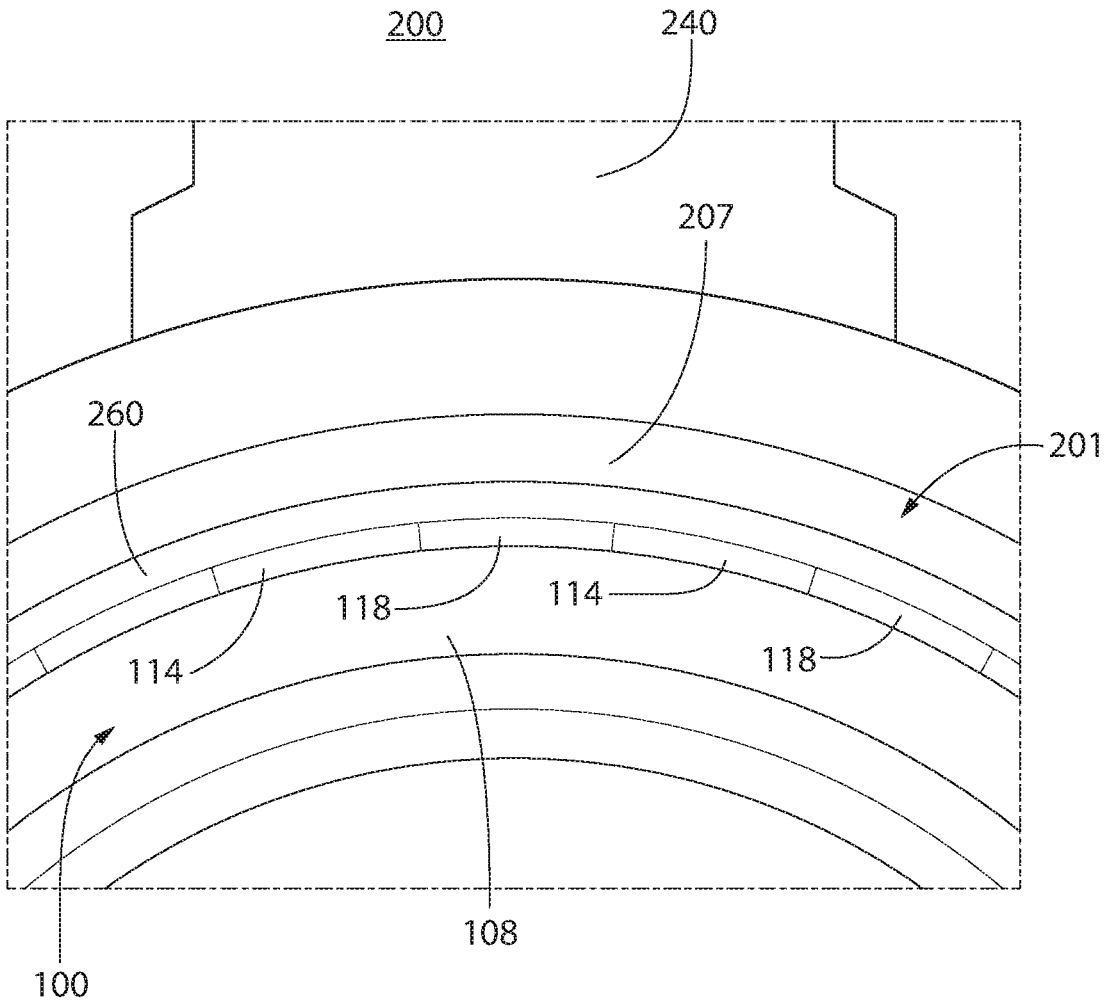
FIG. 16 is an enlarged view of a portion of the container of FIG. 14.

FIG. 16 shows an enlarged view of a portion of FIG. 14. As shown, there is at least one gap 118 between top-edge portion 108 of insert 100 and inner surface 207 of container body 201. Accordingly, it will be appreciated that gaps 118 provide corresponding fluid pathways through which void 116 (FIG. 15B) and interior compartment 102 of insert 100 can be in fluid communication. Stated differently, air within interior compartment 102 is in fluid communication with (i.e., exposed to and/or able to freely move into) void 116. It should be understood that the gaps 118 providing fluid pathways enable air to transfer relatively freely between the interior compartment 102 and the void 116. These gaps are distinguishable from the microscopic interconnecting channels through the entrained polymer that facilitate moisture vapor transmission to desiccant contained within the microscopic channels.

As stated above, a goal of the disclosed concept is to increase the surface area over which insert 100 is exposed to air in order to facilitate absorption of moisture by desiccant insert 100. Accordingly, by providing at least one fluid pathway (e.g., through gaps 118) between void 116 and interior compartment 102 of insert 100, outer surface 104 is uniquely and advantageously exposed to air within container body 201. This facilitates greater moisture absorption by insert 100, as compared with more conventional containers wherein desiccant inserts are commonly flush with inner surfaces of container bodies and thus cannot absorb moisture from both sides.

In one alternative exemplary embodiment of the disclosed concept, an insert is provided without ridges or detents, and instead a plurality of protrusions are provided on an inner surface of a container body. This is essentially an inverse of the configuration wherein the insert has the ridges. This alternative embodiment also creates a clearance between portions of the inner surface of the container body and the outer surface of the insert, while simultaneously securing insert within container body. In such an embodiment, an exposed outer surface of the corresponding insert is exposed to air within the interior compartment for moisture absorption.

Preferably, the insert is a blend comprising a base material and a desiccant (or other active agent), as discussed above. However, in one aspect, the invention encompasses inserts that may not include such a blend. For example, in one alternative exemplary embodiment, the insert is composed of a base material (e.g., polymer or rigid paper) with desiccant coated on either surface thereof. In another alternative embodiment, the insert is made of a polymer with a foaming agent, making it sponge-like. Optionally, in any embodiment, the base material is a non-polymeric binder, e.g., clay.

Figure 17:
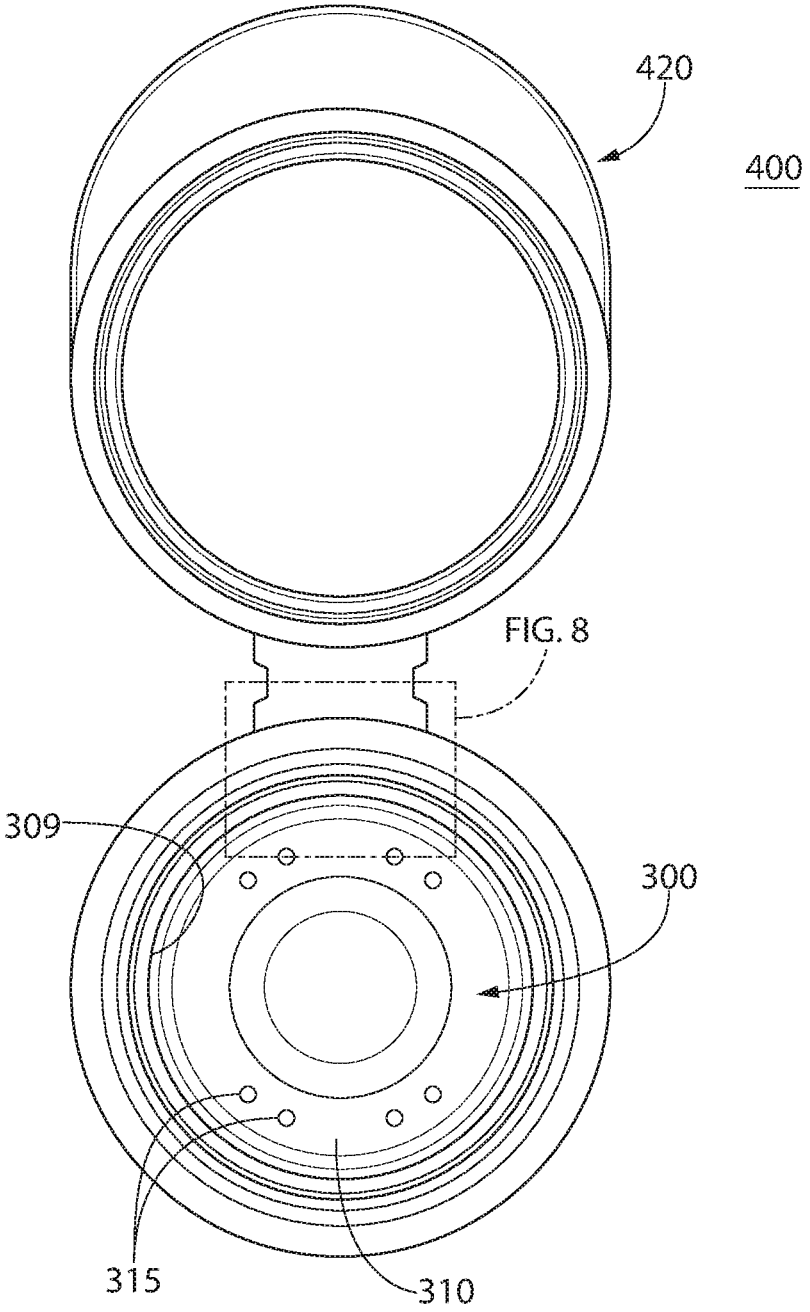
FIG. 17 is a top view of another container, in accordance with another non-limiting embodiment of the disclosed concept.
Figure 18:
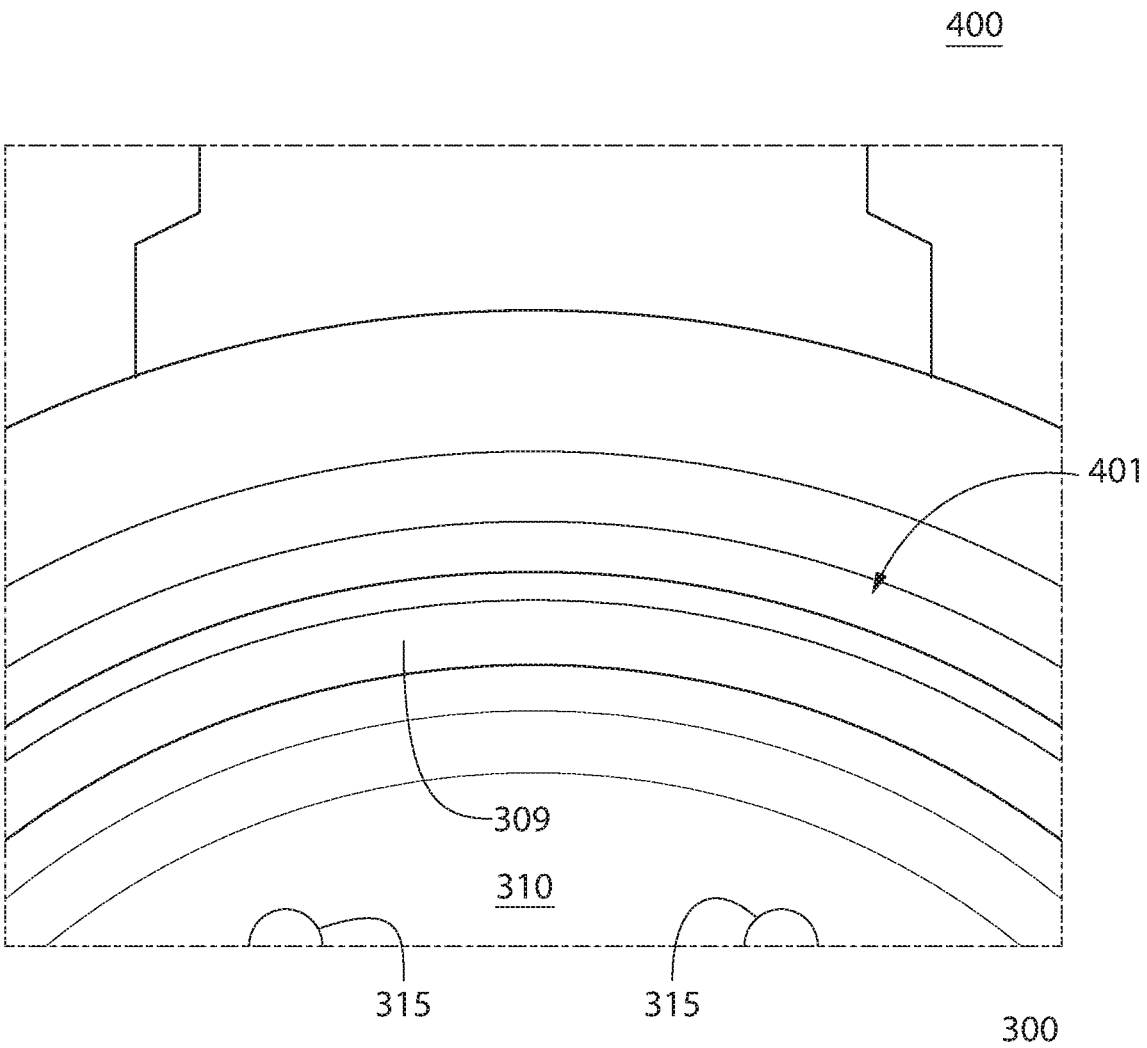
FIG. 18 is an enlarged view of a portion of the container of FIG. 17.
Figure 19:
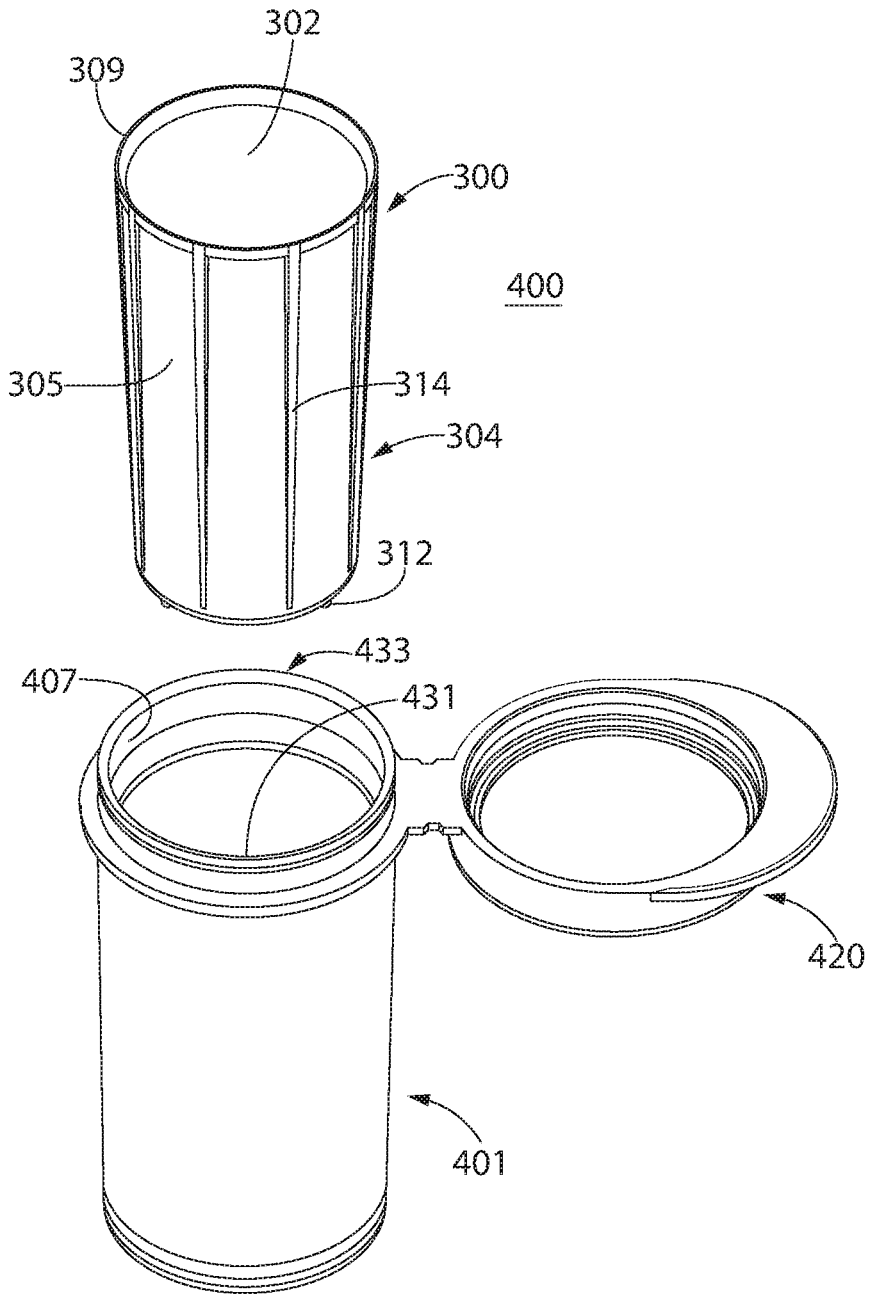
FIG. 19 is an exploded isometric view of the container of FIG. 17.
Figure 20:
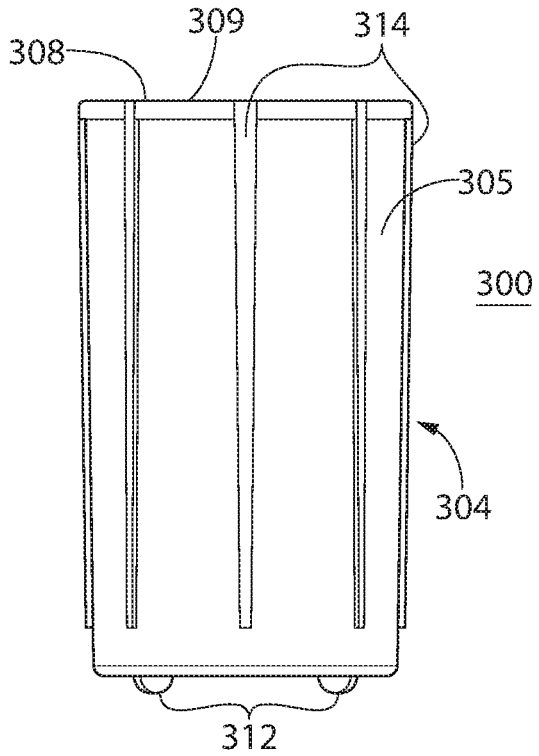
FIGS. 20 and 21 are isometric views of an insert for the container of FIG. 17.
Figure 21:
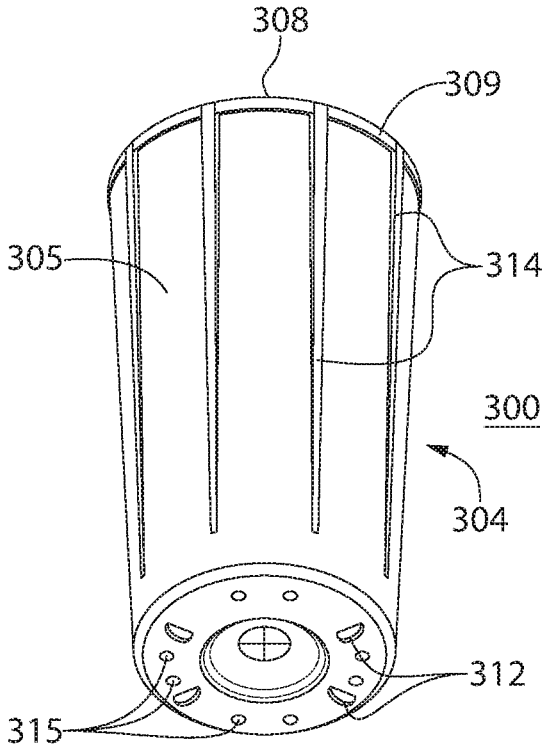
Figure 22:
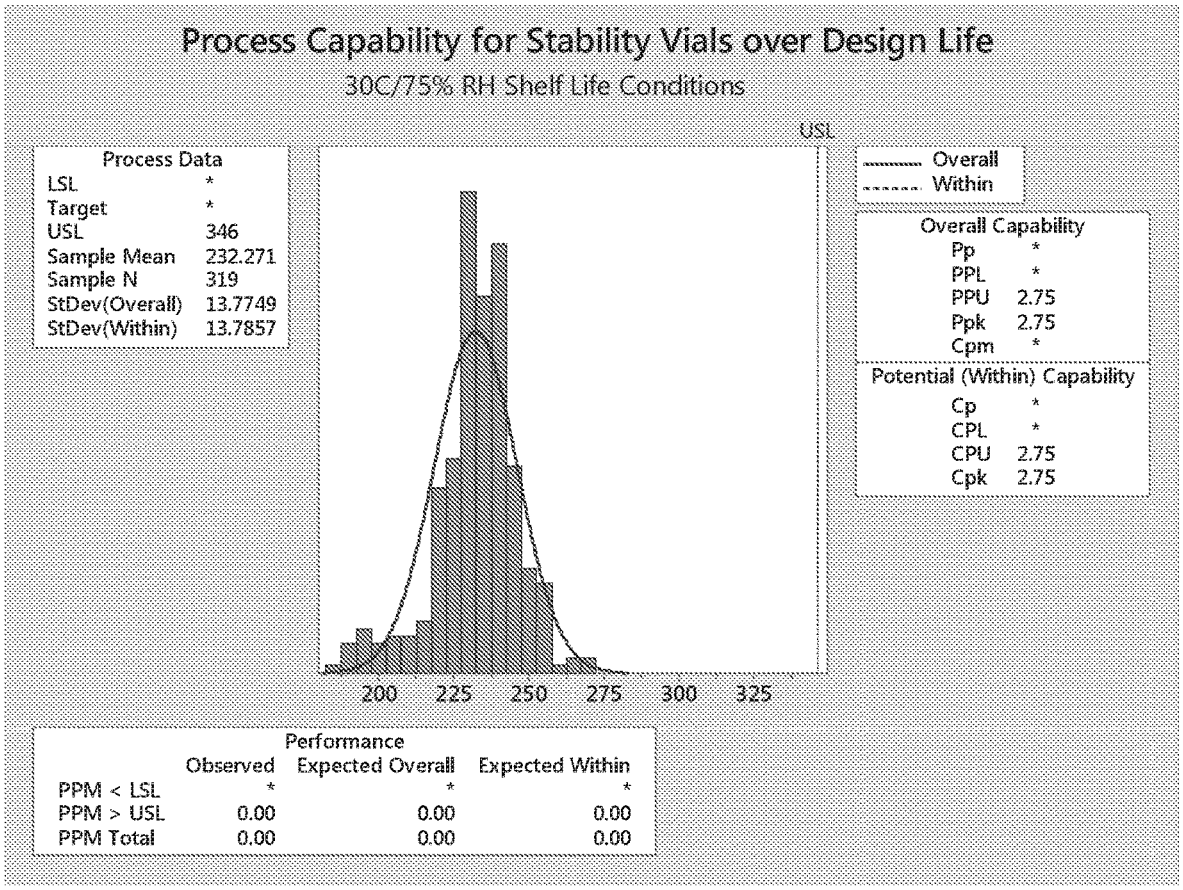
FIG. 22 is a graph and related data showing moisture ingress (in μg/day) for a sampling of containers in accordance with a non-limiting embodiment of the disclosed concept.

FIGS. 17-19 show different views of a container 400, and FIGS. 20 and 21 show different views of a desiccant insert 300 for container 400, in accordance with another non-limiting embodiment of the disclosed concept. It is noted that optionally, the container 400 of FIG. 17 may incorporate any of the sealing configurations described herein with reference to FIGS. 1-10B. Desiccant insert 300 provides substantially the same advantages for container 400 as desiccant insert 100 provides for container 200, discussed above. Accordingly, like components are indicated with like reference numerals.

As shown in FIGS. 20 and 21, desiccant insert 300, in addition to including detents 312 and ridges 314, further includes an annular-shaped lip 309 extending radially outwardly from top-edge 308. As such, desiccant insert 300 provides the aforementioned advantages in terms of increased surfaced area (i.e., via detents 312 and ridges 314) for improved moisture absorption, and further provides additional advantages. More specifically, lip 310 extends from top-edge 308 to an inner surface 407 (FIG. 19) of container body 401 in order to provide a barrier against fluid entry to the space between inner surface 407 (FIG. 19) of container body 401 and an outer surface 304 (FIG. 19) of insert 300. This will be appreciated with reference to FIG. 18, in which lip 309 is shown blocking fluid entry (and by extension, blocking ingress of solid materials) into this region of container 400. In other words, there are no gaps 118 as those described with respect to the above described container 200. Accordingly, the possibility for diagnostic test strips, such as blood glucose test strips that are used in diabetic care, being inadvertently inserted or stuck in this location during an automated filling operation, is significantly reduced and/or eliminated.

Furthermore, as seen in FIG. 21, bottom end 310 of insert 300 has a plurality of thru holes 315. It will be appreciated that a void (substantially akin to void 116 of container 200, shown in FIG. 15B) of container 400 is provided between an exposed portion of outer surface 304 of insert 300 a portion of inner surface 407 of container body 401. Furthermore, at least one fluid pathway is provided between the void and an interior compartment 302 (FIG. 19) of insert 300. The fluid pathway of exemplary container 400 is provided through thru holes 315. Although not shown, it will also be appreciated that thru holes could alternatively or in addition be provided on a sidewall 305 of insert in order to provide a fluid pathway between the void and interior compartment 302 of insert 300. Accordingly, moisture absorption capabilities of container 400 are significantly improved by virtue of protrusions 312,314, the resulting void and the fluid pathway through thru holes 315, as compared with more conventional containers, wherein outer surfaces of inserts are commonly flush with inner surfaces of container bodies. While the disclosed concept has been described herein with reference to exemplary embodiments, it should be understood that the invention is not limited thereto. Those skilled in the art with an access to the teachings herein will recognize additional modifications, applications, and embodiments within the scope thereof and additional fields in which the invention would be useful.

Exemplary Methods for Making Containers

Optionally, the container 200,400 is made in an injection molding process. Such process may be at least in part according to the teachings of U.S. Pat. No. 4,783,056 or U.S. Pat. No. RE 37,676, which are incorporated by reference herein in their entireties.

In another aspect of the disclosed concept, methods for making a container 200,400 are provided. Optional methods may include the following steps: (a) providing a container body 201,401 having an opening 233,433 leading to an interior; (b) optionally providing a lid 220,420 that is movable with respect to container body 201,401 to move container 200,400 between a closed position in which lid 220,420 covers the opening 233,433 and an open position in which the opening 233,433 is exposed; (c) securing an insert 100,300 within the interior 231,431 of container body 201, 401; (d) forming a void 116 (or void of container 400) between an exposed portion of an outer surface 104,304 of insert 100,300 and a portion of an inner surface 207,407 of container body 201,401; and (e) forming at least one fluid pathway between void 116 (i.e., and a void of container 400, not shown) and an interior compartment of insert 100,300. The securing step may optionally include any one of the following: (i) press-fitting the insert 100,300 into the container body 201,401 optionally before the polymer material of the container body 201,401 is fully set such that container body 201,401 slightly shrinks about insert 100,300; or (ii) overmolding container body 201,401 around insert 100,300; or (iii) employing a two-shot molding process to make container body 201,401 and insert 100,300.

Optional Characteristics of Container and Desiccant Insert

In any embodiment, the insert according to the invention optionally has a faster moisture uptake rate than a comparable insert that is completely flush with the inner wall of the container body.

Optionally, in any embodiment, the total exposed surface area of the insert 100, 300 (including inner and outer surface) is at least 1.1 times the exposed surface area of the interior compartment 102, 302, optionally at least 1.25 times the exposed surface area of the interior compartment 102, 302, optionally at least 1.5 times the exposed surface area of the interior compartment 102, 302, optionally at least 1.75 times the exposed surface area of the interior compartment 102, 302, optionally at least 2.0 times the exposed surface area of the interior compartment 102, 302, optionally at least 2.5 times the exposed surface area of the interior compartment 102, 302. In a preferred embodiment of a container that Applicants reduced to practice, the total exposed surface area of the insert 100, 300 is about 2.2 times the exposed surface area of the interior compartment 102, 302.

Optionally, in any embodiment, the insert 100, 300 is a single, unitary member, which does not rely on a separate insert or element to provide the void (e.g., 116).

Optionally, in any embodiment, the void (e.g., 116) is provided between both: (a) the bottom end 110 of the insert 100, 300 and the base 203 of the container body 201; and (b) the outer surface 104,304 of the insert and the sidewall 205 of the container body 201.

Optionally, in any embodiment, the insert comprises an active agent in addition to or instead of a desiccant, e.g., an oxygen scavenger.

Optional Features of Container

Optionally, any of the inserts 100, 300 disclosed herein may be used with any of the containers 10, 60 disclosed herein. Preferably, a container according to an aspect of the disclosed concept would incorporate these features to reduce moisture ingress, improve reliability and consistency of container quality during manufacturing, reduce the amount of desiccant required and improve the efficiency of the desiccant insert's moisture uptake. In this way, an improved vial is provided, which optionally provides desired shelf life for moisture sensitive products, e.g., diagnostic test strips.

Design and Performance of 17 mL and 24 mL Next Generation Vials

The 17 mL Next Generation vial, according to optional embodiments, was designed to provide a high quality lower cost alternative to previous vials, while still meeting the performance needs for the protection of blood glucose test strips. The ability to reduce costs is based on two key factors:

(1) A reduction in sleeve weight. The design reduces the desiccant mass in the vial by ~60% by replacing the current 3-phase desiccant sleeve (having desiccant, channel former and base polymer) of the standard vial with a lighter 3-phase desiccant sleeve of the same formulation. This is made possible by improvements in seal design that reduce the moisture ingress into the vial significantly.

(2) Modifications in vial manufacturing process to improve efficiency and to take cost out. The current process generally utilizes higher cavitation tooling and the 100% inspection process is physically separated with work-in-progress inventory held in between the two steps. The new vial manufacturing and inspection processes are fully integrated which not only takes out additional cost but improves the feedback loop enabling faster responses to any issues.

The key to the protection of the test strip is to maintain a low relative humidity (RH) over useful life of the test strips. The two key factors in vial design are the absorption capacity of the vial and the ability of the vial to block moisture from entering the vial (moisture ingress).

Figure 23:
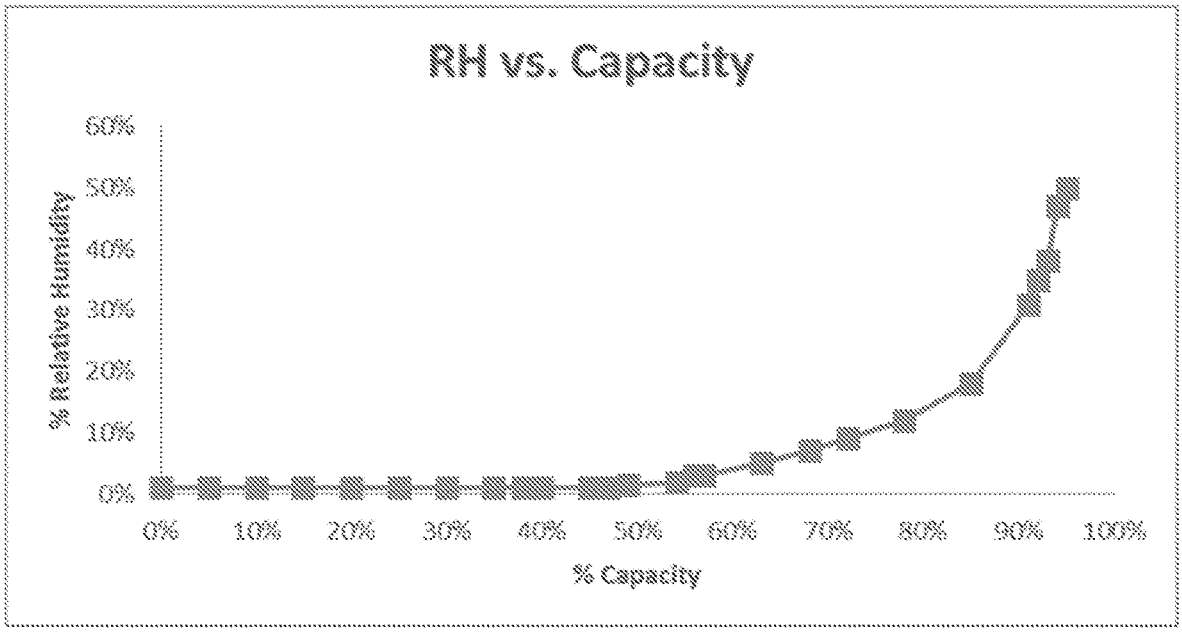
FIG. 23 is a graph plotting percentage relative humidity versus percentage capacity in accordance with a non-limiting embodiment of the disclosed concept.

The ability to absorb an amount of moisture is a function of the type and quantity of desiccant used. In the case of a standard Activ-Vial™ product, it is 4 A molecular sieve. The relative humidity inside the vial is a function of the % of the molecular sieve's capacity to absorb. This is a fixed property of the desiccant and is well characterized. In addition Applicant has characterized this RH vs. Capacity Curve in Applicant's 3-phase desiccant formulation as shown in FIG. 23.

The Next Generation 17 mL vial, which is an optional embodiment of the disclosed concept, is designed to maintain 10% RH throughout the life of the product at a specific set of environmental assumptions that we characterize in our design document we refer to as a Moisture Budget.

Figure 24:
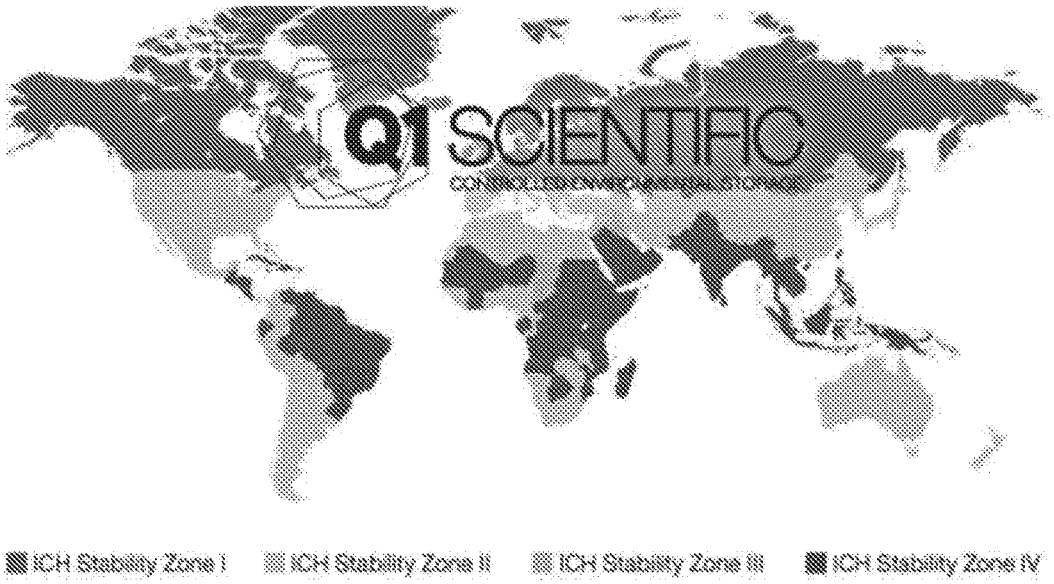
FIG. 24 is an image showing International Council on Harmonization (ICH) Guidelines for the average temperature and humidity for the various environmental zones around the world.

The environmental assumptions in the moisture budget are based on the use of ICH (International Council on Harmonization) Guidelines for the average temperature and humidity for the various environmental zones around the world, as shown in FIG. 24 and the tables below.

| Zone | Type of Climate |
|---|---|
| Zone I | Temperate zone |
| Zone II | Mediterranean/subtropical zone |
| Zone III | Hot dry zone |
| Zone IV | Hot humid/tropical zone |
| Zone IVb | ASEAN testing conditions hot/hotter humidity |

| Climatic Zone | Temperature | Humidity |
|---|---|---|
| Zone I | 21° C. ± 2° C. | 45% rH ± 5% rH |
| Zone II | 25° C. ± 2° C. | 60% rH ± 5% rH |
| Zone III | 30° C. ± 2° C. | 35% rH ± 5% rH |
| Zone IV | 30° C. ± 2° C. | 65% rH ± 5% rH |
| Zone IVb | 30° C. ± 2° C. | 75% rH ± 5% rH |

Based on the vial design parameters and the design environmental conditions, a calculation of the amount of moisture the vial must absorb during the useful life is generated. Calculations of max allowable moisture load for Next Generation 17 mL vial are provided below:

| I. Calculations | | |
|---|---|---|
| 1 | Vial/lid | 0.1 mg |
| 2 | CSP Manufacturing Life Opening | |
| | Mess water vepor in one opening | 276 μg |
| | Number of Openings | 1 |
| | CSP Manufacturing Life Opening load | 0.276 mg |
| 3 | Storage @ CSP | |
| | Maximum Number of Years of Storage | 1 years |
| | Storage @ CSP load | 5.4 mg |
| 4 | Storage @ Customer | |
| | Maximum Number of Years of Storage | 1 |
| | Storage @ Customer load | 8.9 mg |
| 5 | Customer Manufacturing Life Opening | |
| | Mass water vapor in one opening | 276 μg |
| | Number of Openings | 1 |
| | Customer Manufacturing Life Opening load | 0.276 mg |
| 6 | Moisture in one strip | 0.05 mg |
| | Total Moisture from Device Package | 2.5 mg |
| 7 | Moisture From Patient Opening 1 Time | 0.455 mg |
| | Total Moisture from Use Life (50 Openings) | 22.8 mg |
| 8 | Shelf Storage | |
| | Minimum Number of Potential Years of Storage @ 30° C./75% RH | 2.00 years |
| | Shelf Storage load | 253 mg |
| | Grand total moisture load | 293 mg |

The above-shown max allowable moisture load for Next Generation 17 mL vial may be contrasted with the same parameters for the previous vial, which are shown below.

| I. Calculations | | |
|---|---|---|
| 1 | Vial/lid | 0.1 mg |
| 2 | CSP Manufacturing Life Opening | |
| | Mess water vepor in one opening | 276 μg |
| | Number of Openings | 1 |
| | CSP Manufacturing Life Opening load | 0.276 mg |
| 3 | Storage @ CSP | |
| | Maximum Number of Years of Storage | 1 years |
| | Storage @ CSP load | 14.3 mg |
| 4 | Storage @ Customer | |
| | Maximum Number of Years of Storage | 1 years |
| | Storage @ Customer load | 23.6 mg |
| 5 | Customer Manufacturing Life Opening | |
| | Mass water vapor in one opening | 276 μg |
| | Number of Openings | 1 |
| | Customer Manufacturing Life Opening load | 0.276 mg |
| 6 | Moisture in one strip | 0.05 mg |
| | Total Moisture from Device Package | 2.5 mg |
| 7 | Moisture From Patient Opening 1 Time | 0.455 mg |
| | Total Moisture from Use Life (50 Openings) | 22.7 mg |
| 8 | Shelf Storage | |
| | Minimum Number of Potential Years of Storage @ 30° C./75% RH | 2.00 years |
| | Shelf Storage load | 675 mg |
| | Grand total moisture load | 739 mg |

For the 17 ml Next Generation vial, the average ingress requirement over the life of the vial is 346 micrograms/day at 30° C./75% RH with a desiccant sleeve weight requirement of 2.5 grams. For the previous vial, the average ingress requirement over the life of the vial would be 972 micrograms per day with a desiccant sleeve weight of 6.3 grams. This represents a meaningful difference and savings on manufacturing costs.

Figure 25:
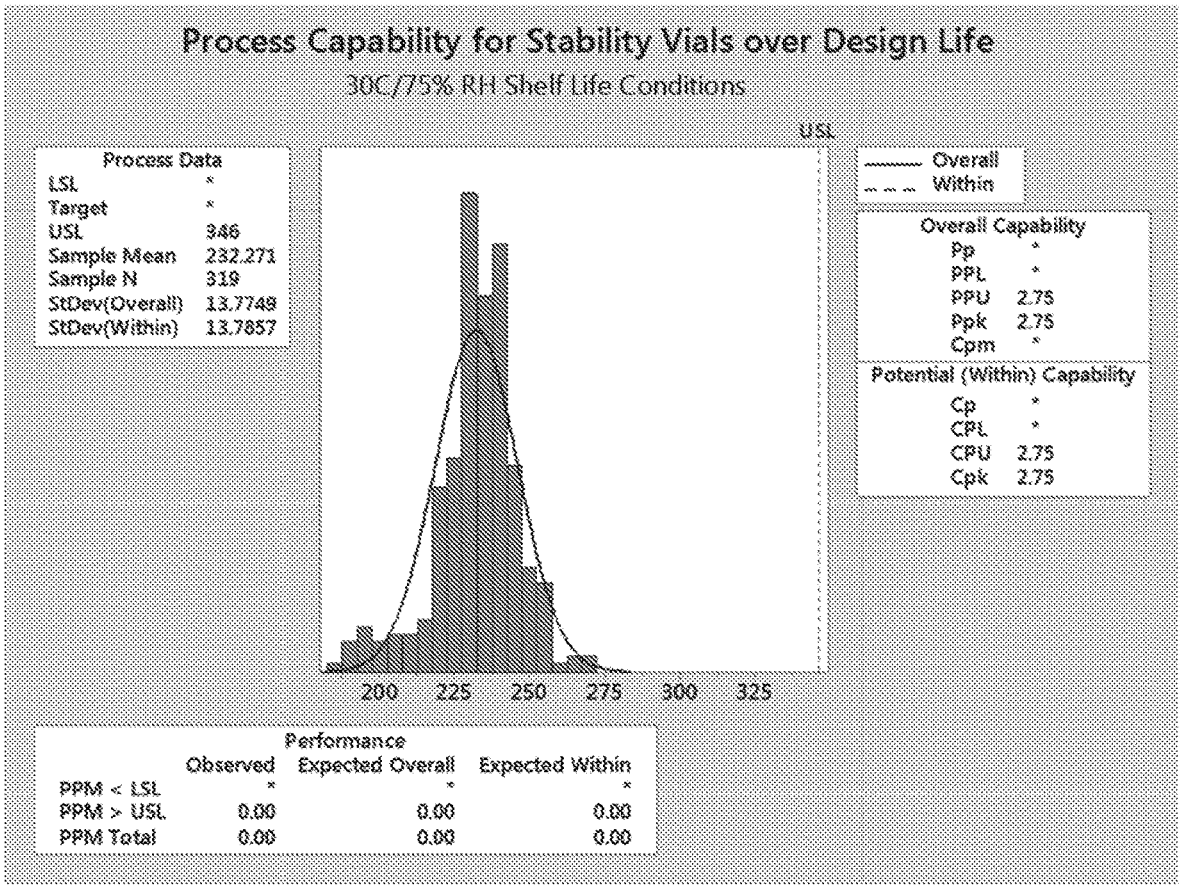
FIG. 25 is a graph and related data showing vials tested for 4 weeks at 30° C./75% RH in accordance with a non-limiting embodiment of the disclosed concept.

Vials were tested for 4 weeks at 30° C./75% RH and then each individual ingress value was processed through the model to generate a projection of the average ingress over the life of the vial. The results demonstrated a very high process capability of 2.75. See FIG. 25. The coefficient of variation for this population is very low at 6%.

Performance of the Next Generation vial is significantly better compared to the previous vial. Under the design environmental conditions of 30° C./75% RH the average ingress over the shelf life is improved by 25% and the coefficient of variability (Std. Dev/Mean) is reduced by 42%. See FIG. 26.

This reduces the upper control limit of the data (Mean+3SD) by 33%.

(a) moisture vapor transmission rate (MVTR) through the vial walls (including base and cap). MVTR can be converted to a per unit basis of micrograms/mm$^2$-day. The data and specifications are based on environmental conditions of 30° C.+/−2° C./80%+/−5% RH externally and 30° C.+/−2° C./0%+5% RH internally. The MVTR is a function of the type of material used and the thickness of the polymer. For any specific polymer the MVTR should be inversely proportional to the thickness, so doubling the thickness will reduce the MVTR per unit area by 50%.

(b) The moisture ingress through the seal. Seal Moisture Ingress can be converted to a per unit basis of micrograms/mm-day where mm refers to the linear length of the seal around the circumference of the vial. The CSP data and proposed specifications are based on environmental conditions of 30° C.+/−2° C./80%+/−5% RH externally and 30° C.+/−2° C./0%+5% RH internally. The moisture ingress through the seal is a function of the design of the seal system and the manufacturing quality used to produce the seal.

The two sizes of Next Generation vials typically used in the self-monitoring blood glucose market were tested. The smaller size is referred to as a 17 mL vial or volume and the larger size as a 24 mL vial or volume. These sizes are understood by persons of skill in the art. Populations of 17 mL and 24 mL Next Generation vials were tested for overall ingress rate and the results are contained in FIG. 28.

Using the ratios between the total surface area and the seal length of each vial, assuming that the seal quality was identical between both populations and the MVTR and the Moisture Vapor through the seal were equal in effect one population can be normalized to the size of the other and in theory the mean ingress should be identical.

| Size | Seal (mm) | Area (sq-mm) | Area Ratio | Seal Ratio | Total |
|---|---|---|---|---|---|
| 24 mL | 93 | 4890 | 1.23 | 1.13 | 1.36 |
| 17 mL | 82 | 3973 | | | |

Figure 28:
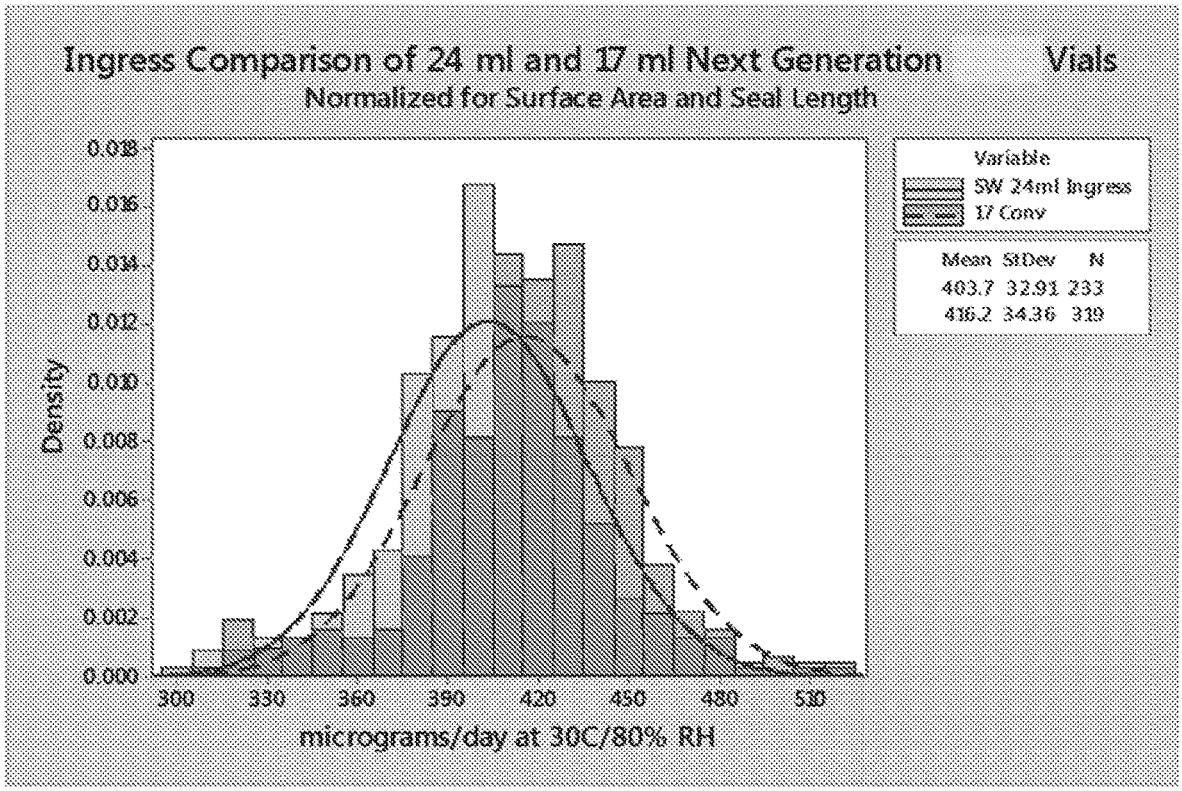
FIG. 28 is a graph and related data in accordance with a non-limiting embodiment of the disclosed concept.

As can be seen in FIG. 28, the results matched within 3% of each other.

Taking the assumption, therefore, that for these size vials the average effect of MVTR between the two populations was 50% and the average effect of seal ingress was 50% a factor of MVTR and for the seal ingress on a per unit basis was calculated.

| Size | Seal (mm) | Area (sq-mm) | MVTR factor | Seal Factor |
|---|---|---|---|---|
| 24 ml | 93 | 4890 | 0.04 | 2.20 |
| 17 ml | 82 | 3973 | 0.04 | 1.80 |

As the MVTR factor is based on the property of the polymer and the wall thickness this factor was held constant for both vials. The tightness or quality of the seal is the primary source of variability and so this factor was calculated separately for each size vial so that the calculated results matched the measured results as closely as possible.

| Size | Calc MVTR | Calc. Seal ingress | Total Calc. Igress | Measure Ingress | % Diff |
|---|---|---|---|---|---|
| 24 ml | 196 | 205 | 400 | 404 | 99.1% |
| 17 ml | 159 | 148 | 307 | 299 | 102.5% |

To determine the range for the seal ingress factor, the UCL (mean+3*SD) and the LCL (mean−3*SD) for each population was used to define the variability in the moisture seal ingress performance as measured at 30 C/80% RH for 4 weeks on a daily basis and then plotting the data for each vial and using the slope of a fitted linear regression line as the ingress rate for each vial.

The seal factor for the UCL was increased until the Cpk's of the actual test populations showed a capability to the calculated UCL of approximately a 2.0 (six-sigma capability).

| UCL | MVTR factor | Seal Factor | Calc UCL 1 | Measure | CPK |
|---|---|---|---|---|---|
| 24 ml | 0.040 | 4.30 | 596 | 532 | 1.94 |
| 17 ml | 0.040 | 3.52 | 448 | 373 | 1.91 |

Figure 29:
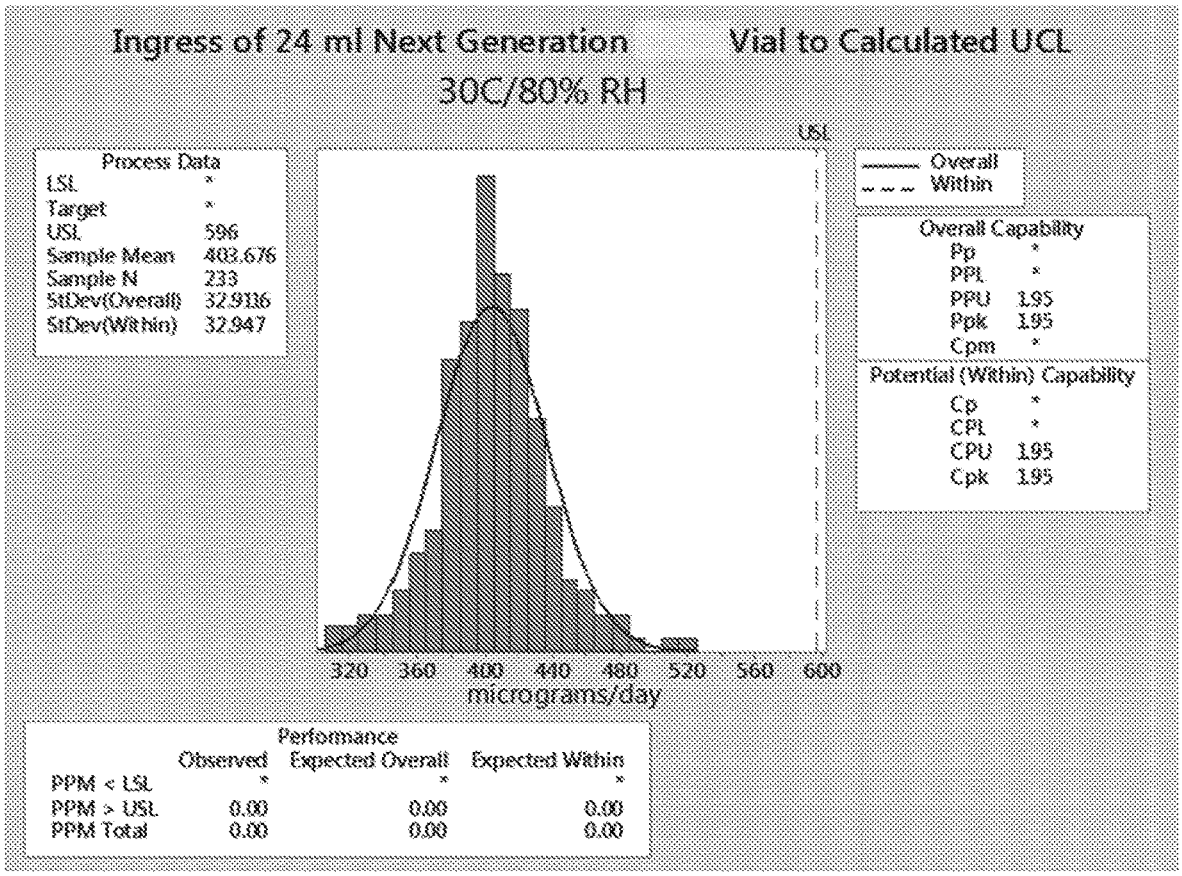
FIG. 29 is a further graph and related data in accordance with a non-limiting embodiment of the disclosed concept.
Figure 30:
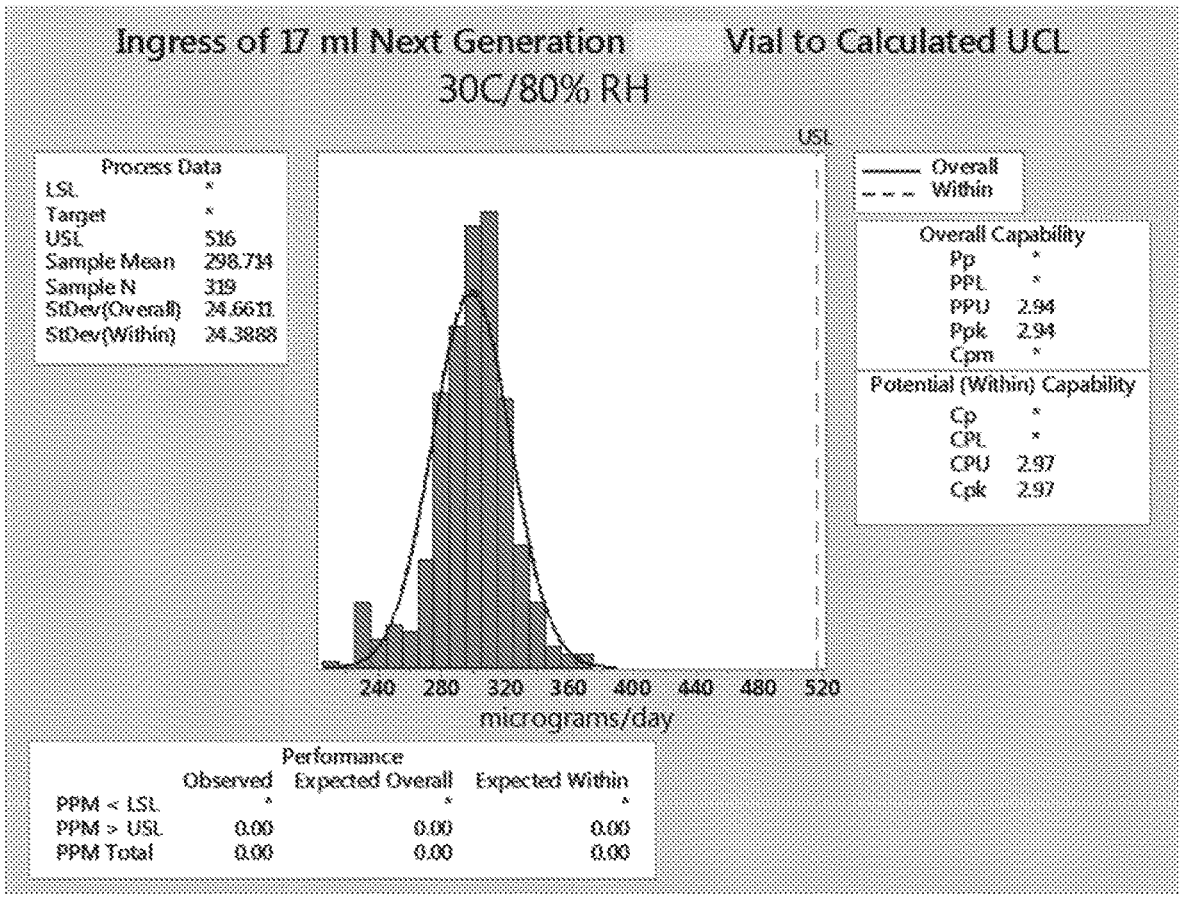
FIG. 30 is an additional graph and related data in accordance with a non-limiting embodiment of the disclosed concept.

Referring to FIGS. 29 and 30, in comparison if we compare the performance of a previous vial to the proposed performance of the Next Generation vial seal we can see that the previous vial is not capable of meeting the design criteria.

Figure 31:
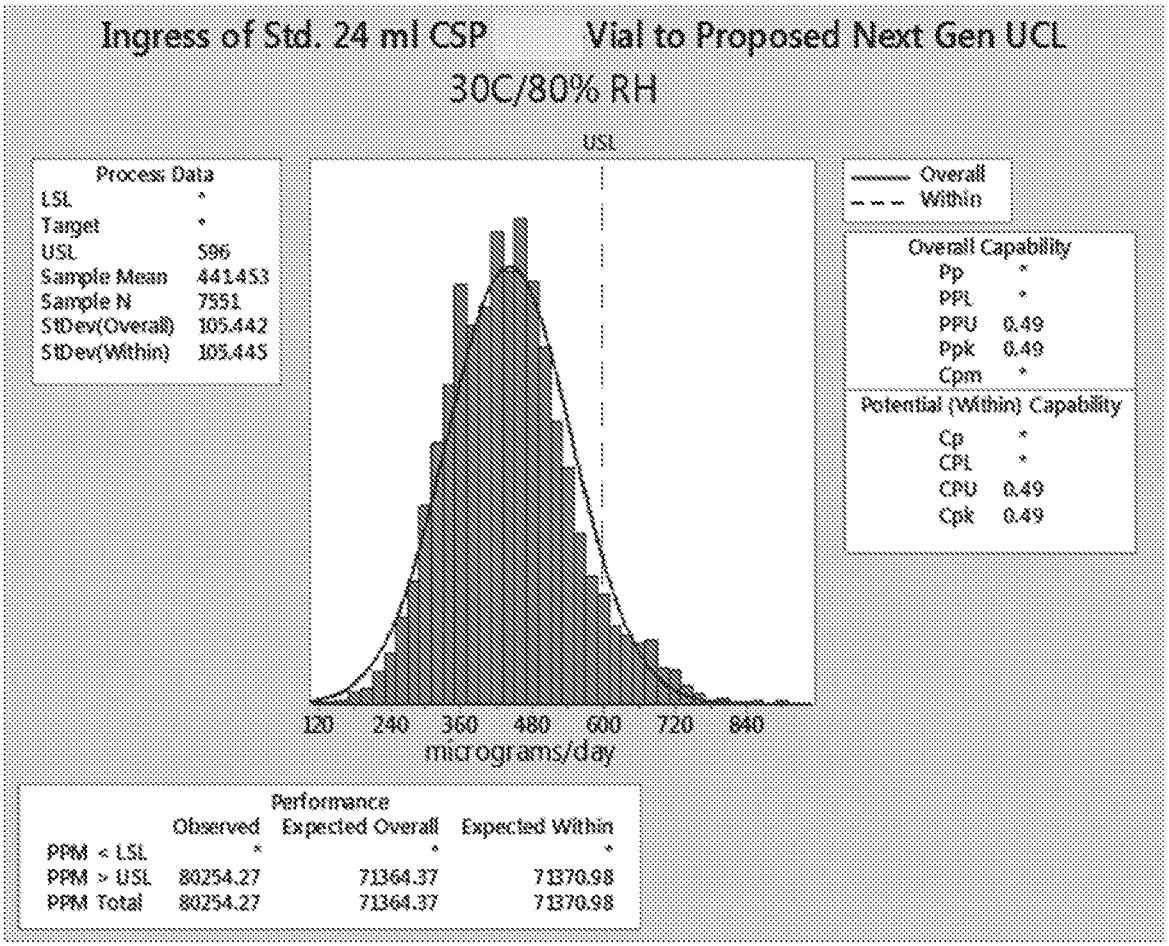
FIG. 31 is a further graph and related data in accordance with a non-limiting embodiment of the disclosed concept.
Figure 32:
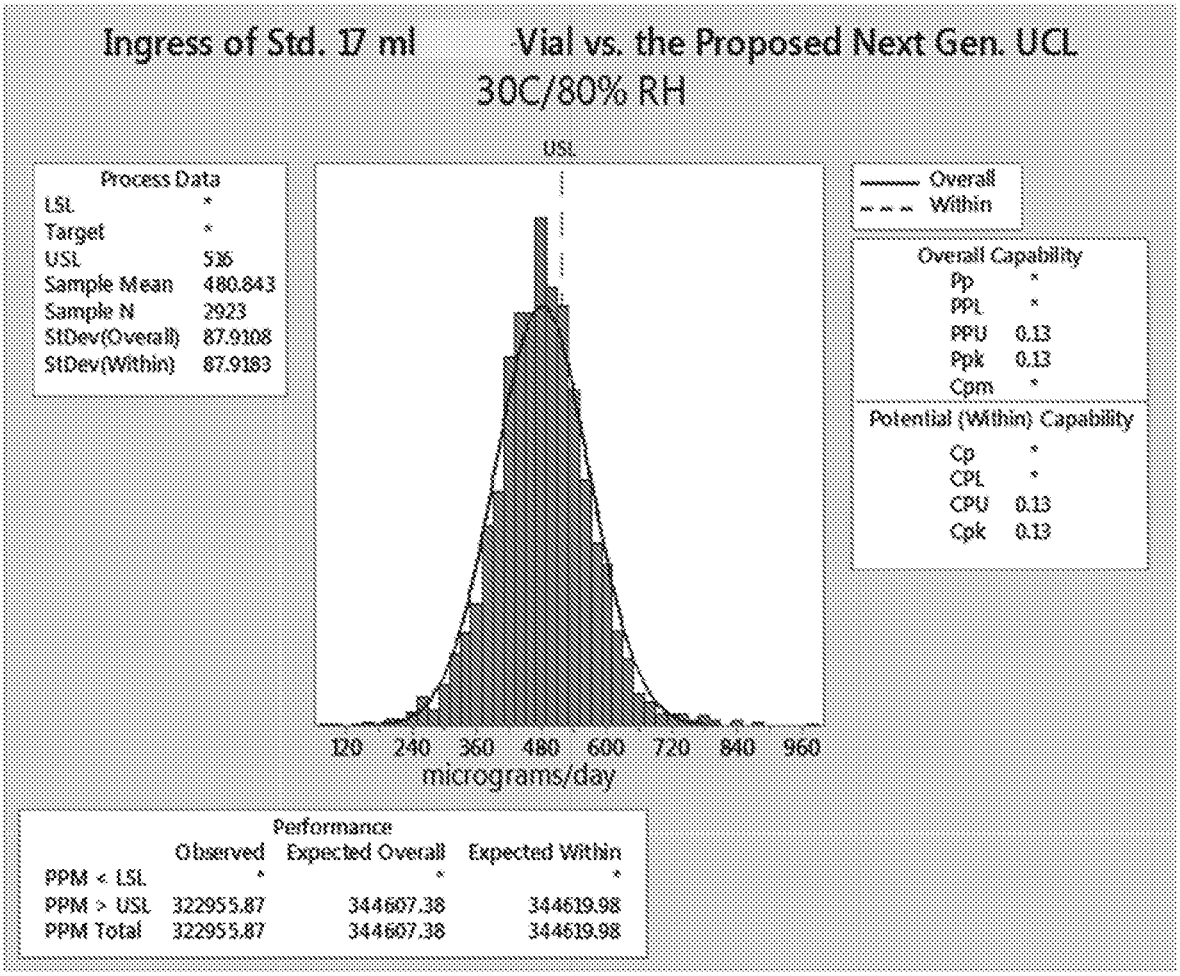
FIG. 32 is another graph and related data in accordance with a non-limiting embodiment of the disclosed concept.

Referring to FIGS. 31 and 32, even the previous vial with an additional polypropylene inner lip seal does not match the criteria for the Next Generation vial.

Figure 33:
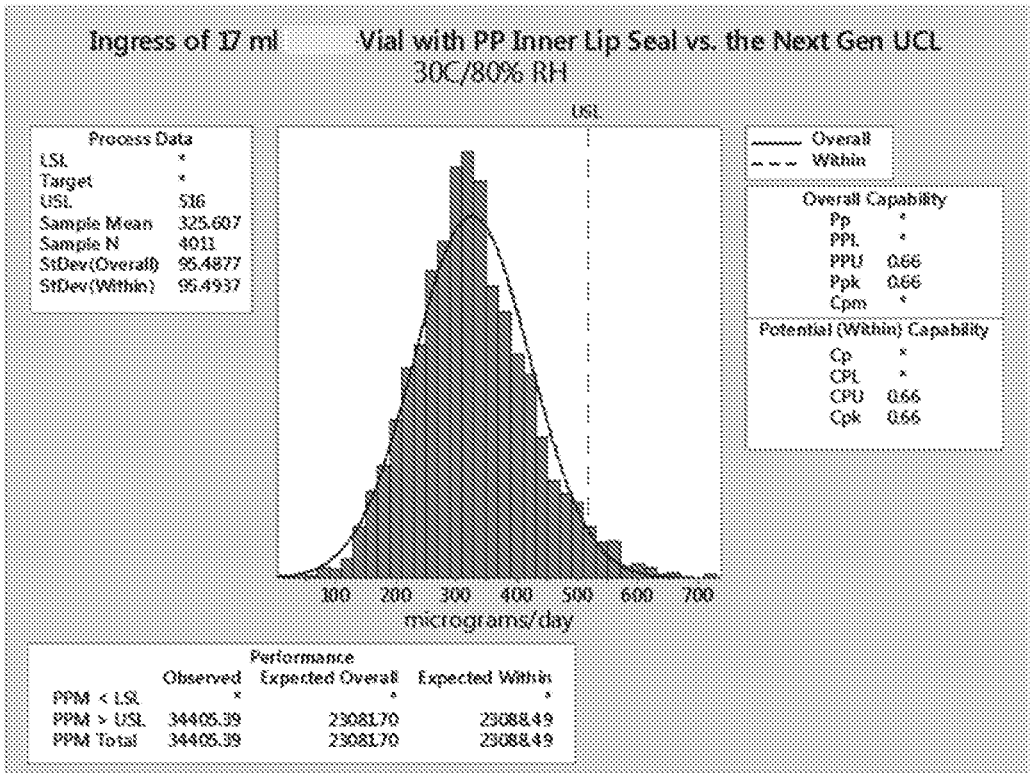
FIG. 33 is a final graph and related data in accordance with a non-limiting embodiment of the disclosed concept.

Referring to FIG. 33, the ingress performance of the Next Generation vial is significantly better than performance of the previous vial, allowing for a significant reduction in required desiccant mass to meet the requirements of packaging and protecting moisture sensitive blood glucose test strips.

The performance of the Next Generation vial seal can optionally be defined as having a moisture ingress rate through the seal of less than or equal to 4.3 micrograms/day per linear mm of seal length as measured with an external environment of 30° C.+/−2° C./80%+/5% RH and an internal environment of 30° C.+/12° C./0%+5% RH when measured over a 4 week period by taking weight measurements on a daily basis using a scale of sufficient precision to measure to 0.0001 grams, plotting the data and using the slope of the linear regression to define the overall moisture ingress of the vial, then subtracting out the MVTR of the body and cap and dividing by the seal length as measured in mm.

The presently disclosed technology has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

While the invention has been described in detail and with reference to specific examples thereof, it will be apparent to one skilled in the art that various changes and modifications can be made therein without departing from the spirit and scope thereof.

What is claimed is:

1. A method for storing and preserving moisture sensitive products, the method comprising:

(a) providing a moisture tight container formed of a polymeric material, the container having an internal volume in a range of 12 mL to 30 mL, the container comprising:

(i) a container body having a base and a sidewall extending therefrom, the container body defining an interior, the container body further having an opening leading to the interior;

(ii) a lid connected to the container body by a hinge, the lid being pivotable about the hinge with respect to the container body to move the container between a closed position in which the lid covers the opening so as to create a moisture tight seal with the container body and an open position in which the opening is exposed; and (iii) an insert secured within the interior of the container body, the insert comprising a base material and a desiccant, wherein the base material provides structure to the insert and is a polymer, the insert having an insert opening leading to an interior compartment configured for housing moisture sensitive products;

(b) disposing a plurality of moisture sensitive products into the interior compartment when the container is in the open position; and (c) moving the container into the closed position, thereby creating the moisture tight seal between the lid and the container body, the moisture tight seal comprising a plurality of engaged mating seals in series between the container body and the lid when the container is in the closed position, the plurality of engaged mating seals including at least a first seal and a second seal, the second seal being formed by mating a thermoplastic sealing surface of the container body with an elastomeric sealing surface of the lid, the elastomeric sealing surface comprising an elastomeric ring that is configured to be compressed by an upper surface of a rim surrounding the opening when the container is in the closed position, wherein vertical compression of the elastomeric ring causes a portion of the ring to elastically expand radially outward into a void provided between the container body and the lid;

wherein:

(aa) the container provides a shelf life to the moisture sensitive products of at least 18 months;

(bb) the container, when in the closed position, has a moisture vapor transmission rate, at ambient conditions of 30° C. and 75% relative humidity (RH), of less than 500 μg/day; and (cc) the insert is less than 3.25 g in mass.

2. The method of claim 1, wherein the first seal is formed by mating a thermoplastic sealing surface of the container body to a thermoplastic sealing surface of the lid.

3. The method of claim 1, wherein the first seal includes an undercut of the container body relative to a central axis of the container body or a lip seal member extending downward from the lid.

4. The method of claim 2, wherein the first seal requires an opening force to transition the container from the closed position to the opened position and the second seal in combination with the first seal does not require a force greater than the opening force to transition the container from the closed position to the opened position.

5. The method of claim 1, wherein the container requires an opening force to transition the container from the closed position to the opened position and wherein the opening force is from 3 to 7 lbf (pound-force).

6. The method of claim 2, wherein the first seal includes an undercut of the container body relative to a central axis of the container body, wherein the undercut is provided in a lip extending upwards from the sidewall and surrounding the opening, the lid including a depending skirt, the undercut having a surface that mates with a corresponding surface of the skirt, forming the first seal.

7. The method of claim 1, wherein an undercut surface of the container body engages an undercut surface of the lid in a snap-fit closing relationship.

8. The method of claim 7, wherein the undercut surface of the container body and/or the undercut surface of the lid do not extend completely around a respective perimeter thereof.

9. The method of claim 2, wherein the elastomer or elastomeric ring is from 0.25 mm to 1.25 mm thick.

10. A moisture tight container, the container having an internal volume in a range of 12 mL to 30 mL, the container comprising:

(a) a container body having a base and a sidewall extending therefrom, the container body defining an interior, the container body further having an opening leading to the interior and a lip surrounding the opening;

(b) a lid being movable with respect to the container between a closed position in which the lid covers the opening so as to create a moisture tight seal with the container body and an open position in which the opening is exposed;

(c) at least a first seal and a second seal, the first seal being formed by mating thermoplastic-to-thermoplastic sealing surfaces of the lid and the container body respectively, the first seal including an undercut of the container body relative to a central axis of the container body or a lip seal member extending downward from the lid, the second seal being formed by mating elastomer-to-thermoplastic sealing surfaces, wherein the elastomer-to-thermoplastic sealing surfaces includes an elastomer formed in the lid or on the container body, wherein the elastomer is compressible and resilient; and (d) an insert secured within the interior of the container body, the insert comprising a base material and a desiccant, wherein the base material provides structure to the insert and is a polymer, the insert having an insert opening leading to an interior compartment configured for housing products;

wherein:

(i) the container, when in the closed position, has a moisture vapor transmission rate, at ambient conditions of 30° C. and 75% relative humidity (RH), of less than 500 μg/day;

(ii) the insert is between 2.5-3.25 g in mass; and (iii) the container comprises a polymeric material.

11. The container of claim 10, wherein the is lid connected to the container body by a hinge, the lid being pivotable about the hinge with respect to the container body to move the container between the closed position and the open position.

12. The container of claim 10, wherein the second seal is formed by mating a thermoplastic sealing surface of the container body with an elastomeric sealing surface of the lid, the elastomeric sealing surface comprising an elastomeric ring that is configured to be compressed by an upper surface of a rim surrounding the opening when the container is in the closed position, wherein vertical compression of the elastomeric ring causes a portion of the ring to elastically expand radially outward into a void provided between the container body and the lid, the elastomeric sealing ring having a Shore A hardness of from 20 to 50.

13. The container of claim 10, wherein the first seal requires an opening force to transition the container from the closed position to the opened position and the second seal in combination with the first seal does not require a force greater than the opening force to transition the container from the closed position to the opened position.

14. The container of claim 10, wherein the container requires an opening force to transition the container from the closed position to the opened position and wherein the opening force is from 3 to 7 lbf (pound-force).

15. The container of claim 10, wherein the elastomer is from 0.25 mm to 1.25 mm thick.

16. The container according to claim 10, wherein the insert is an entrained polymer further comprising a channeling agent.

17. A process for manufacturing a group of at least forty (40) moisture tight flip-top vials so as to reduce a standard deviation of moisture ingress of the vials, wherein each group consists of 17 mL vials or 24 mL vials, the process comprising, for each vial:

(a) providing a container body having a base and a sidewall extending therefrom, the container body defining an interior, the container body further having an opening leading to the interior and a lip surrounding the opening;

(b) providing a lid connected to the container body by a hinge, the lid being pivotable about the hinge with respect to the container body to move the vial between a closed position in which the lid covers the opening so as to create a moisture tight seal with the container body and an open position in which the opening is exposed; and (c) providing at least a first seal and a second seal, the first seal being formed by mating thermoplastic-to-thermoplastic sealing surfaces of the lid and the container body respectively, the first seal including an undercut of the container body relative to a central axis of the container body or a lip seal member extending downward from the lid, the second seal being formed by mating elastomer-to-thermoplastic sealing surfaces, wherein the elastomer-to-thermoplastic sealing surfaces includes an elastomer formed in the lid or on the container body, wherein the elastomer is compressible and resilient;

wherein:

(i) the group of at least 40 17 mL vials, when in the closed position, has a mean moisture vapor transmission rate, at ambient conditions of 30° C. and 80% relative humidity (RH), of from 275 μg/day to 325 μg/day, with a standard deviation of less than 30; or (ii) the group of at least 40 24 mL vials, when in the closed position, has a mean moisture vapor transmission rate, at ambient conditions of 30° C. and 80% relative humidity (RH), of from 375 μg/day to 425 μg/day, with a standard deviation of less than 40.

18. The process of claim 17, wherein the second seal is formed by mating a thermoplastic sealing surface of the container body with an elastomeric sealing surface of the lid, the elastomeric sealing surface comprising an elastomeric ring that is configured to be compressed by an upper surface of a rim surrounding the opening when the vial is in the closed position, wherein vertical compression of the elastomeric ring causes a portion of the ring to elastically expand radially outward into a void provided between the container body and the lid.

19. The process of claim 17, wherein the first seal requires an opening force to transition the vial from the closed position to the opened position and the second seal in combination with the first seal does not require a force greater than the opening force to transition the vial from the closed position to the opened position.

20. The process of claim 17, wherein the vial requires an opening force to transition the vial from the closed position to the opened position and wherein the opening force is from 3 to 7 lbf (pound-force).

21. The process of claim 17, wherein the first seal and the second seal combined provide the vial when the lid is in the closed position a lower moisture vapor transmission rate (MVTR) than the first seal would provide without the second seal.

22. The process of claim 17, wherein the elastomer is from 0.25 mm to 1.25 mm thick.

23. The process of claim 22, the elastomer being in the form of an elastomeric sealing ring having a Shore A hardness of from 20 to 50.

* * * * *